US012338601B2

(12) United States Patent
Wu et al.

(10) Patent No.: US 12,338,601 B2
(45) Date of Patent: Jun. 24, 2025

(54) SHOVEL

(71) Applicant: SUMITOMO HEAVY INDUSTRIES, LTD., Tokyo (JP)

(72) Inventors: Chunnan Wu, Kanagawa (JP); Yusuke Sano, Kanagawa (JP); Yasuhiro Yamamoto, Kanagawa (JP); Yoshiyasu Itsuji, Kanagawa (JP); Kazunori Hiranuma, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 490 days.

(21) Appl. No.: 17/654,871

(22) Filed: Mar. 15, 2022

(65) Prior Publication Data

US 2022/0195690 A1 Jun. 23, 2022

Related U.S. Application Data

(63) Continuation of application No. PCT/JP2020/035425, filed on Sep. 18, 2020.

(30) Foreign Application Priority Data

Sep. 18, 2019 (JP) ..... 2019-169178

(51) Int. Cl.
*E02F 3/43* (2006.01)
*E02F 3/32* (2006.01)
(Continued)

(52) U.S. Cl.
CPC ..... *E02F 3/437* (2013.01); *E02F 3/32* (2013.01); *E02F 3/43* (2013.01); *E02F 3/439* (2013.01);
(Continued)

(58) Field of Classification Search
None
See application file for complete search history.

(56) References Cited

U.S. PATENT DOCUMENTS 6,247,538 B1 6/2001 Takeda et al.
2009/0218112 A1 9/2009 Mintah et al.
(Continued)

FOREIGN PATENT DOCUMENTS

JP H10-088625 4/1998
JP H11-286967 10/1999
(Continued)

OTHER PUBLICATIONS

Screen captures and transcript from YouTube video clip entitled "How to Load a Dump Truck| Heavy Equipment Operator Training" 14 pages, uploaded on Jul. 12, 2019 by user "Heavy Metal Learning". Retrieved from Internet: < https://www.youtube.com/watch?v=WI8RvftZCXM> (Year: 2019).*
(Continued)

*Primary Examiner* — Peter D Nolan
*Assistant Examiner* — Michael F Whalen
(74) *Attorney, Agent, or Firm* — IPUSA, PLLC

(57) ABSTRACT

A shovel includes a lower traveling structure, an upper swing structure swingably mounted on the lower traveling structure, and a hardware processor provided on the upper swing structure. The hardware processor is configured to recognize the position of a dump truck and create a target trajectory for a dumping operation.

15 Claims, 21 Drawing Sheets

(51) Int. Cl.
*E02F 9/26* (2006.01)
*E02F 3/28* (2006.01)
*E02F 3/42* (2006.01)

(52) U.S. Cl.
CPC ..... *E02F 9/262* (2013.01); *E02F 3/28* (2013.01); *E02F 3/425* (2013.01); *E02F 9/265* (2013.01)

(56) References Cited

U.S. PATENT DOCUMENTS

| | | | | |
|---|---|---|---|---|
| 2012/0130599 | A1* | 5/2012 | Faivre | E02F 9/265 701/50 |
| 2012/0191431 | A1* | 7/2012 | Dunbabin | E02F 9/2029 703/6 |
| 2017/0073935 | A1* | 3/2017 | Friend | E02F 9/265 |
| 2018/0119384 | A1 | 5/2018 | Imaizumi et al. | |
| 2018/0142441 | A1 | 5/2018 | Berry et al. | |
| 2018/0171582 | A1 | 6/2018 | Yamada et al. | |
| 2018/0305902 | A1 | 10/2018 | Tsukamoto | |
| 2019/0093311 | A1 | 3/2019 | Naito | |
| 2020/0248434 | A1* | 8/2020 | Konda | E02F 9/2033 |
| 2021/0272315 | A1* | 9/2021 | Kawamoto | E02F 3/439 |
| 2021/0292998 | A1* | 9/2021 | Kawamoto | E02F 9/261 |

FOREIGN PATENT DOCUMENTS

| | | |
|---|---|---|
| JP | 2011-514456 | 5/2011 |
| JP | 2016-089388 | 5/2016 |
| JP | 2016-089559 | 5/2016 |
| WO | 2017/010212 | 1/2017 |
| WO | 2017/115809 | 7/2017 |
| WO | 2017/126182 | 7/2017 |
| WO | 2019/151335 | 8/2019 |

OTHER PUBLICATIONS

Haul Truck loading procedures, North American Construction Group, Form 99C-F-003_Rev2, Aug. 16, 2016: Discussing proper loading techniques for a haul truck. (Year: 2016).*

International Search Report for PCT/JP2020/035425 mailed on Dec. 8, 2020.

* cited by examiner

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2020/035425, filed on Sep. 18, 2020 and designating the U.S., which claims priority to Japanese Patent Application No. 2019-169178, filed on Sep. 18, 2019. The entire contents of the foregoing applications are incorporated herein by reference.

BACKGROUND

Technical Field

The present disclosure relates to shovels.

Description of Related Art

A hydraulic excavator in which a semi-autonomous excavation control system is installed has been known. This excavation control system is configured to autonomously perform a boom raising and swing operation when a predetermined condition is satisfied.

SUMMARY

According to an embodiment of the present invention, a shovel includes a lower traveling structure, an upper swing structure swingably mounted on the lower traveling structure, and a hardware processor provided on the upper swing structure. The hardware processor is configured to recognize the position of a dump truck and create a target trajectory for a dumping operation.

DETAILED DESCRIPTION

According to the related-art excavation control system, a dumping operation is supposed to be manually performed. Therefore, the excavation control system cannot improve the efficiency of a dumping operation.

Therefore, it is desired to provide a shovel that can autonomously perform a dumping operation.

According to an embodiment of the present invention, a shovel that can autonomously perform a dumping operation is provided.

Figure 1A:
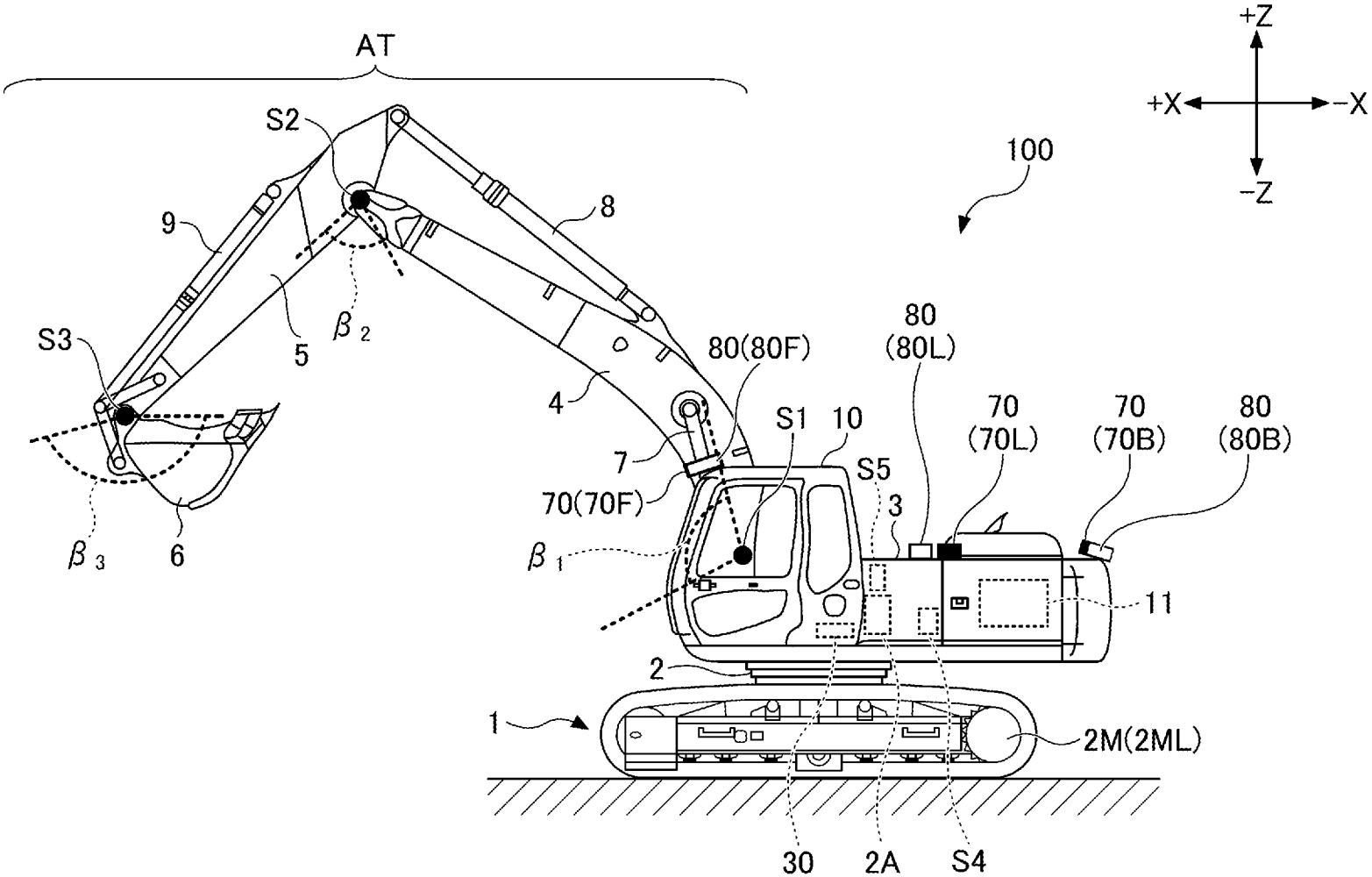
FIG. 1A is a side view of a shovel according to an embodiment of the present invention.
Figure 1B:
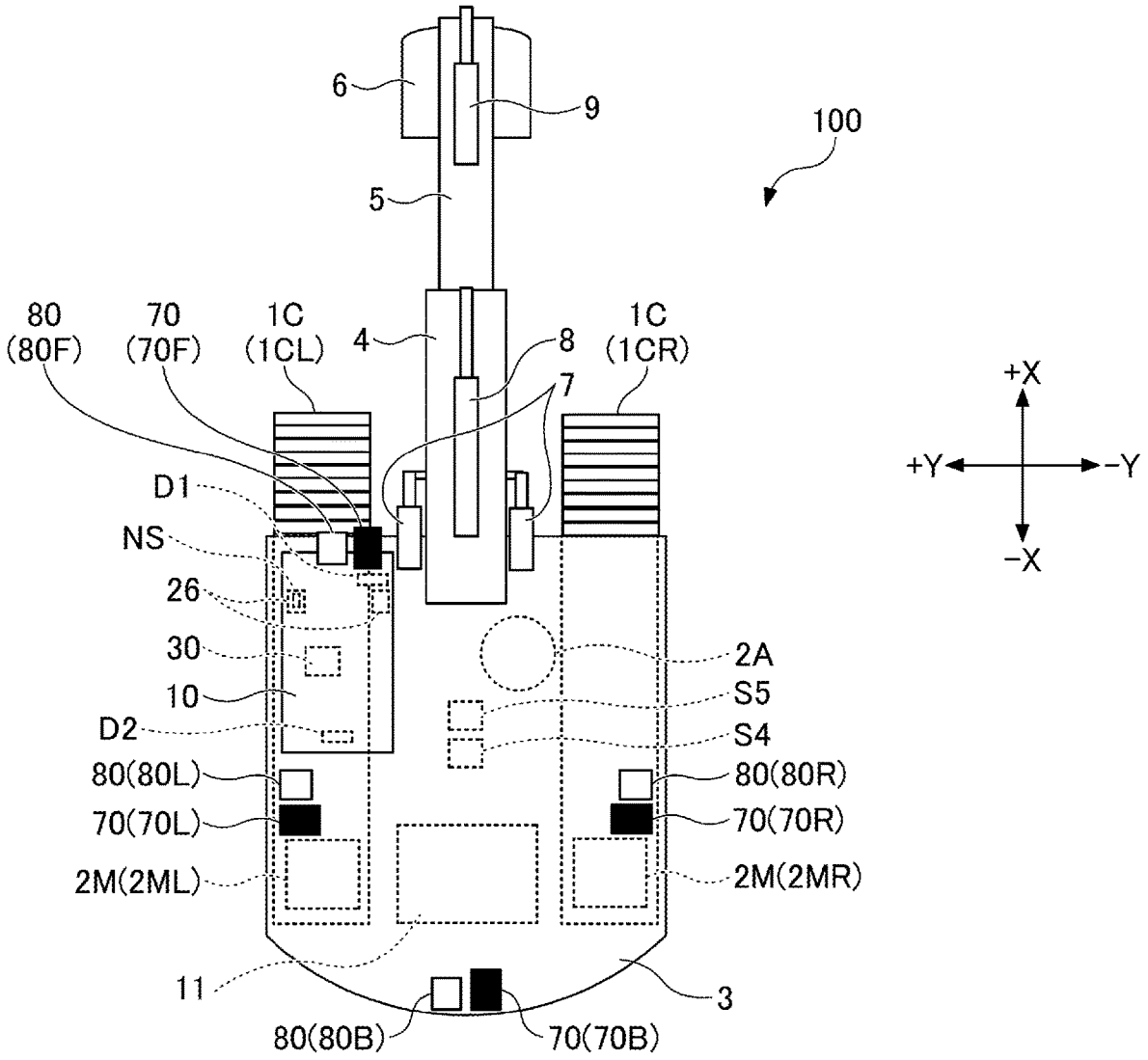
FIG. 1B is a top plan view of the shovel according to the embodiment of the present invention.

First, a shovel 100 as an excavator according to an embodiment of the present invention is described with reference to FIGS. 1A and 1B. FIG. 1A is a side view of the shovel 100. FIG. 1B is a top plan view of the shovel 100.

According to this embodiment, a lower traveling structure 1 of the shovel 100 includes a crawler 1C. The crawler 1C is driven by a travel hydraulic motor 2M mounted on the lower traveling structure 1. Specifically, the crawler 1C includes a left crawler 1CL and a right crawler 1CR. The travel hydraulic motor 2M includes a left travel hydraulic motor 2ML and a right travel hydraulic motor 2MR. The left crawler 1CL is driven by the left travel hydraulic motor 2ML. The right crawler 1CR is driven by the right travel hydraulic motor 2MR.

An upper swing structure 3 is swingably mounted on the lower traveling structure 1 via a swing mechanism 2. The swing mechanism 2 is driven by a swing hydraulic motor 2A mounted on the upper swing structure 3. A swing motor generator as an electric actuator may be an alternative to the swing hydraulic motor 2A.

A boom 4 is attached to the upper swing structure 3. An arm 5 is attached to the distal end of the boom 4. A bucket 6 serving as an end attachment is attached to the distal end of the arm 5. The boom 4, the arm 5, and the bucket 6 constitute an excavation attachment AT that is an example of an attachment. The boom 4 is driven by a boom cylinder 7.

The arm 5 is driven by an arm cylinder 8. The bucket 6 is driven by a bucket cylinder 9.

The boom 4 is supported in such a manner as to be able to pivot upward and downward relative to the upper swing structure 3. A boom angle sensor S1 is attached to the boom 4. The boom angle sensor S1 can detect a boom angle $\beta_1$ that is the pivot angle of the boom 4. The boom angle $\beta_1$ is, for example, a rise angle from the most lowered position of the boom 4. Therefore, the boom angle $\beta_1$ is maximized when the boom 4 is most raised.

The arm 5 is supported in such a manner as to be pivotable relative to the boom 4. An arm angle sensor S2 is attached to the arm 5. The arm angle sensor S2 can detect an arm angle $\beta_2$ that is the pivot angle of the arm 5. The arm angle $\beta_2$ is, for example, an opening angle from the most closed position of the aim 5. Therefore, the arm angle $\beta_2$ is maximized when the arm 5 is most opened.

The bucket 6 is supported in such a manner as to be pivotable relative to the arm 5. A bucket angle sensor S3 is attached to the bucket 6. The bucket angle sensor S3 can detect a bucket angle $\beta_3$ that is the pivot angle of the bucket 6. The bucket angle $\beta_3$ is, for example, an opening angle from the most closed position of the bucket 6. Therefore, the bucket angle $\beta_3$ is maximized when the bucket 6 is most opened.

According to the embodiment illustrated in FIGS. 1A and 1B, each of the boom angle sensor S1, the arm angle sensor S2, and the bucket angle sensor S3 is constituted of a combination of an acceleration sensor and a gyroscope. Each of the boom angle sensor S1, the arm angle sensor S2, and the bucket angle sensor S3, however, may be constituted of an acceleration sensor only. Furthermore, the boom angle sensor S1 may also be a stroke sensor attached to the boom cylinder 7, a rotary encoder, a potentiometer, an inertial measurement unit or the like. The same applies to the arm angle sensor S2 and the bucket angle sensor S3.

A cabin 10 as a cab is provided on and one or more power sources are mounted on the upper swing structure 3. According to this embodiment, an engine 11 serving as a power source is mounted on the upper swing structure 3. Furthermore, an object detector 70, an image capturing device 80, a machine body tilt sensor S4, a swing angular velocity sensor S5, etc., are attached to the upper swing structure 3. An operating device 26, a controller 30, a display device D1, a sound output device D2, etc., are provided in the cabin 10. In this specification, for convenience, the side of the upper swing structure 3 on which side the excavation attachment AT is attached is defined as the front side and the side of the upper swing structure 3 on which side a counterweight is attached is defined as the back side.

The object detector 70, which is an example of a space recognition device, is configured to detect an object present in an area surrounding the shovel 100. Examples of objects include persons, animals, vehicles, construction machines, buildings, walls, fences, and holes. Examples of the object detector 70 include an ultrasonic sensor, a millimeter wave radar, a stereo camera, a LIDAR, a distance image sensor, and an infrared sensor. According to this embodiment, the object detector 70 includes a front sensor 70F attached to the front end of the upper surface of the cabin 10, a back sensor 70B attached to the back end of the upper surface of the upper swing structure 3, a left sensor 70L attached to the left end of the upper surface of the upper swing structure 3, and a right sensor 70R attached to the right end of the upper surface of the upper swing structure 3. Each sensor is constituted of a LIDAR.

The object detector 70 may also be configured to detect a predetermined object within a predetermined area set in an area surrounding the shovel 100. That is, the object detector 70 may also be configured to be able to identify the type of an object. For example, the object detector 70 may also be configured to be able to distinguish between a person and an object other than a person. The object detector 70 may also be configured to calculate a distance from the object detector 70 or the shovel 100 to a recognized object.

In response to determining that a person is present within the range of a predetermined distance (a predetermined range) from the shovel 100 with the space recognition device (the object detector 70) before an actuator operates, the controller 30 may disable the actuator or cause the actuator to operate very slowly even when the controller 30 has already output a command to operate. The actuator is, for example, a hydraulic actuator, an electric actuator or the like. Examples of hydraulic actuators include the boom cylinder 7, the arm cylinder 8, and the bucket cylinder 9.

Specifically, in response to determining that a person is present within the predetermined range, the controller 30 can disable the actuator by putting a selector valve (such as a gate lock valve) placed in a pilot circuit in a locking state. In the case of an electric operating lever, the controller 30 can disable, the actuator by disabling a signal from the controller 30 to a control valve for operation. In the case of causing the actuator to operate very slowly, the controller 30 may, for example, diminish the signal from the controller 30 to the control valve for operation. Thus, in response to determining that a person is present within the predetermined range, the controller 30 prevents the actuator from being driven or causes the actuator to operate very slowly even when the controller 30 has already generated a command to operate. Furthermore, in response to determining that a person is present within the predetermined range while an operator is operating an operating lever, the controller 30 may stop or decelerate the movement of the actuator independent of the operator's operation. Specifically, in response to determining that a person is present within the predetermined range, the controller 30 stops the actuator by putting a selector valve (such as a gate lock valve) placed in a pilot circuit in a locking state. In the case of using a control valve for operation, the controller 30 can disable the actuator or cause the actuator to operate very slowly by disabling a signal to the control valve for operation or outputting a command to decelerate to the control valve for operation. The control valve for operation is configured to output a pilot pressure commensurate with a control command from the controller 30 and apply the pilot pressure to a pilot port of a corresponding control valve in a control valve unit 17. Furthermore, when the object detected by the object detector 70 is a dump truck, the controller 30 does not have to execute stop control. In this case, the controller 30 may control the operation of the actuator in such a manner as to avoid the detected dump truck. Thus, the controller 30 can appropriately control the operation of the actuator based on the type of a detected object.

The image capturing device 80 is configured to capture an image of an area surrounding the shovel 100. According to this embodiment, the image capturing device 80 includes a back camera 80B attached to the back end of the upper surface of the upper swing structure 3, a front camera 80F attached to the front end of the upper surface of the cabin 10, a left camera 80L attached to the left end of the upper surface of the upper swing structure 3, and a right camera 80R attached to the right end of the upper surface of the upper swing structure 3.

The back camera 80B is placed next to the back sensor 70B. The front camera 80F is placed next to the front sensor 70F. The left camera 80L is placed next to the left sensor 70L. The right camera 80R is placed next to the right sensor 70R.

An image captured by the image capturing device 80 is displayed on the display device D1. The image capturing device 80 may be configured such that a viewpoint change image such as an overhead view image can be displayed on the display device D1. The overhead view image is created by combining the respective output images of the back camera 80B, the left camera 80L, and the right camera 80R, for example.

The image capturing device 80 may also be used as the object detector 70. In this case, the object detector 70 may be omitted.

The machine body tilt sensor S4 is configured to detect a tilt of the upper swing structure 3 relative to a predetermined plane. According to this embodiment, the machine body tilt sensor S4 is an acceleration sensor to detect the tilt angle of the upper swing structure 3 about its longitudinal axis and the tilt angle of the upper swing structure 3 about its lateral axis with respect to a virtual horizontal plane. The longitudinal axis and the lateral axis of the upper swing structure 3 cross each other at right angles and pass through a shovel central point that is a point on the swing axis of the shovel 100, for example.

The swing angular velocity sensor S5 is configured to detect the swing angular velocity of the upper swing structure 3. According to this embodiment, the swing angular velocity sensor S5 is a gyroscope. The swing angular velocity sensor S5 may also be a resolver, a rotary encoder, or the like. The swing angular velocity sensor S5 may also detect a swing speed. The swing speed may be calculated from the swing angular velocity.

In the following, each of the boom angle sensor S1, the arm angle sensor S2, the bucket angle sensor S3, the machine body tilt sensor S4, and the swing angular velocity sensor S5 may also be referred to as a pose detector.

The display device D1 is a device to display information. The sound output device D2 is a device to output a sound. The operating device 26 is a device that the operator uses to operate actuators.

The controller 30 is a control device for controlling the shovel 100. According to this embodiment, the controller 30 is constituted of a computer that includes a CPU, a volatile storage, and a nonvolatile storage. The controller 30 reads programs corresponding to functions from the nonvolatile storage, loads the programs into the volatile storage, and causes the CPU to execute corresponding processes. Examples of functions include a machine guidance function to guide the operator in manually operating the shovel 100 and a machine control function to automatically assist the operator in manually operating the shovel 100.

Figure 2:
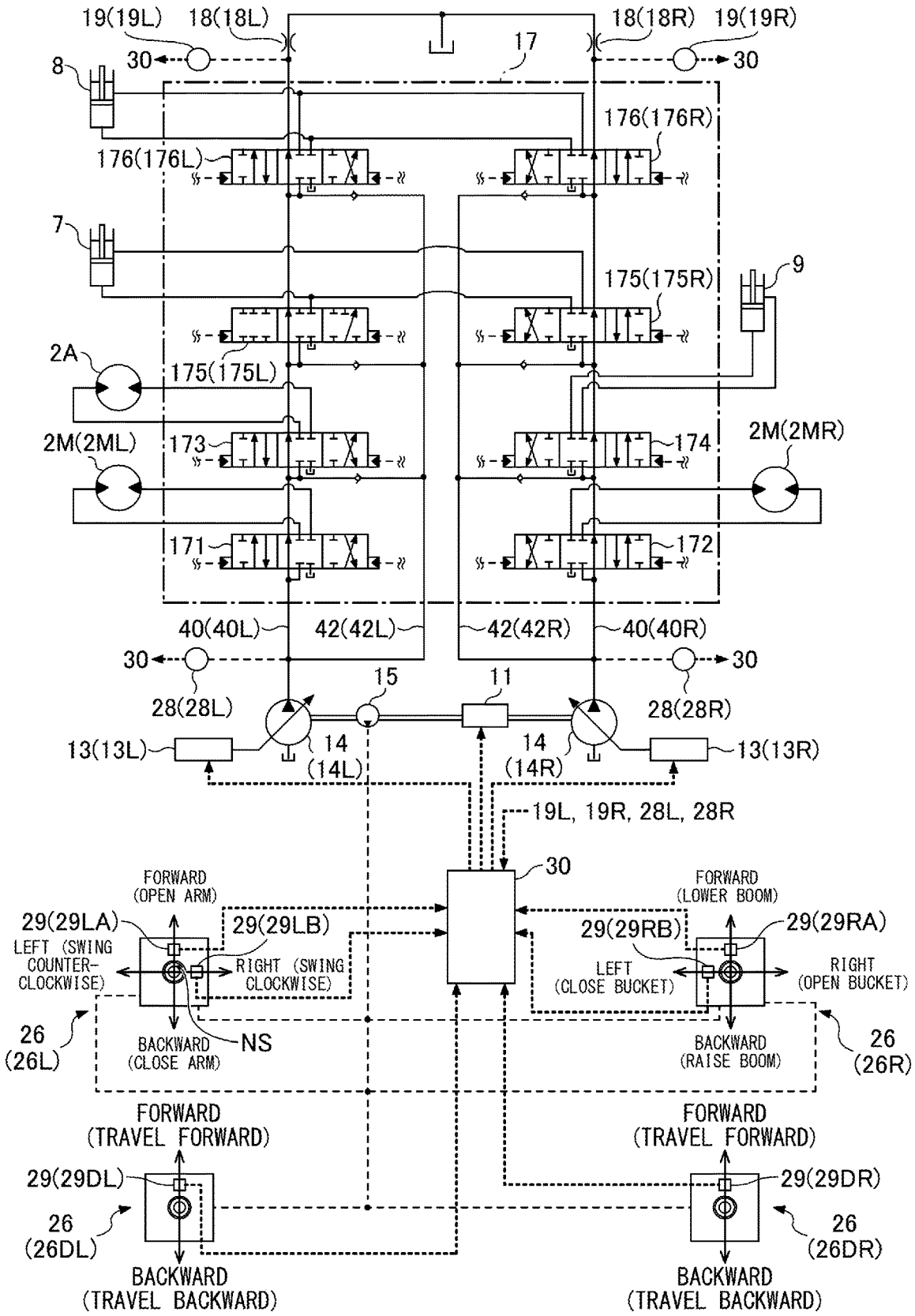
FIG. 2 is a diagram illustrating an example configuration of a hydraulic system installed in the shovel.

Next, an example configuration of a hydraulic system installed in the shovel 100 is described with reference to FIG. 2. FIG. 2 is a diagram illustrating an example configuration of the hydraulic system installed in the shovel 100. In FIG. 2, a mechanical power transmission line, a hydraulic oil line, a pilot line, and an electrical control line are indicated by a double line, a solid line, a dashed line, and a dotted line, respectively.

The hydraulic system of the shovel 100 mainly includes the engine 11, a regulator 13, a main pump 14, a pilot pump 15, the control valve unit 17, the operating device 26, a discharge pressure sensor 28, an operating pressure sensor 29, and the controller 30.

In FIG. 2, the hydraulic system circulates hydraulic oil from the main pump 14 driven by the engine 11 to a hydraulic oil tank via a center bypass conduit 40 or a parallel conduit 42.

The engine 11 is a power source of the shovel 100. According to this embodiment, the engine 11 is, for example, a diesel engine that operates in such a manner as to maintain a predetermined rotational speed. The output shaft of the engine 11 is connected to the input shaft of each of the main pump 14 and the pilot pump 15.

The main pump 14 is configured to supply hydraulic oil to the control valve unit 17 via a hydraulic oil line. According to this embodiment, the main pump 14 is a swash plate variable displacement hydraulic pump.

The regulator 13 is configured to control the discharge quantity (geometric displacement) of the main pump 14. According to this embodiment, the regulator 13 controls the discharge quantity (geometric displacement) of the main pump 14 by adjusting the swash plate tilt angle of the main pump 14 in response to a control command from the controller 30.

The pilot pump 15 is configured to supply hydraulic oil to hydraulic control devices including the operating device 26 via a pilot line. According to this embodiment, the pilot pump 15 is a fixed displacement hydraulic pump. The pilot pump 15, however, may be omitted. In this case, the function carried by the pilot pump 15 may be implemented by the main pump 14. That is, the main pump 14 may have the function of supplying hydraulic oil to the operating device 26, etc., after reducing the pressure of the hydraulic oil with a throttle or the like, apart from the function of supplying hydraulic oil to the control valve unit 17.

The control valve unit 17 is configured to control the flow of hydraulic oil in the hydraulic system. According to this embodiment, the control valve unit 17 includes control valves 171 through 176. The control valve 175 includes a control valve 175L and a control valve 175R. The control valve 176 includes a control valve 176L and a control valve 176R. The control valve unit 17 can selectively supply hydraulic oil discharged by the main pump 14 to one or more hydraulic actuators through the control valves 171 through 176. The control valves 171 through 176 control the flow rate of hydraulic oil flowing from the main pump 14 to the hydraulic actuators and the flow rate of hydraulic oil flowing from the hydraulic actuators to the hydraulic oil tank. The hydraulic actuators include the boom cylinder 7, the arm cylinder 8, the bucket cylinder 9, the left travel hydraulic motor 2ML, the right travel hydraulic motor 2MR, and the swing hydraulic motor 2A.

The operating device 26 is a device that the operator uses to operate actuators. The actuators include at least one of a hydraulic actuator and an electric actuator. According to this embodiment, the operating device 26 is configured to supply hydraulic oil discharged by the pilot pump 15 to a pilot port of a corresponding control valve in the control valve unit 17 via a pilot line. The pressure of hydraulic oil supplied to each pilot port (pilot pressure) is a pressure commensurate with the direction of operation and the amount of operation of a lever or a pedal (not depicted) of the operating device 26 corresponding to each hydraulic actuator. The operating device 26, however, may be an electric operating device instead of a hydraulic operating device as described above. In this case, the control valves in the control valve unit 17 may be solenoid spool valves.

The discharge pressure sensor 28 is configured to detect the discharge pressure of the main pump 14. According to this embodiment, the discharge pressure sensor 28 outputs a detected value to the controller 30.

The operating pressure sensor 29 is configured to detect the details of the operator's operation on the operating device 26. According to this embodiment, the operating pressure sensor 29 detects the direction of operation and the amount of operation of the operating device 26 corresponding to each actuator in the form of pressure (operating pressure), and outputs a detected value to the controller 30 as operation data. The operation details of the operating device 26 may also be detected using a sensor other than an operating pressure sensor.

The main pump 14 includes a left main pump 14L and a right main pump 14R. The left main pump 14L is configured to circulate hydraulic oil to the hydraulic oil tank via a left center bypass conduit 40L or a left parallel conduit 42L. The right main pump 14R is configured to circulate hydraulic oil to the hydraulic oil tank via a right center bypass conduit 40R or a right parallel conduit 42R.

The left center bypass conduit 40L is a hydraulic oil line that passes through the control valves 171, 173, 175L, and 176L placed in the control valve unit 17. The right center bypass conduit 40R is a hydraulic oil line that passes through the control valves 172, 174, 175R, and 176R placed in the control valve unit 17.

The control valve 171 is a spool valve that switches the flow of hydraulic oil to supply hydraulic oil discharged by the left main pump 14L to the left travel hydraulic motor 2ML and to discharge hydraulic oil discharged by the left travel hydraulic motor 2ML to the hydraulic oil tank.

The control valve 172 is a spool valve that switches the flow of hydraulic oil to supply hydraulic oil discharged by the right main pump 14R to the right travel hydraulic motor 2MR and to discharge hydraulic oil discharged by the right travel hydraulic motor 2MR to the hydraulic oil tank.

The control valve 173 is a spool valve that switches the flow of hydraulic oil to supply hydraulic oil discharged by the left main pump 14L to the swing hydraulic motor 2A and to discharge hydraulic oil discharged by the swing hydraulic motor 2A to the hydraulic oil tank.

The control valve 174 is a spool valve that switches the flow of hydraulic oil to supply hydraulic oil discharged by the right main pump 14R to the bucket cylinder 9 and to discharge hydraulic oil in the bucket cylinder 9 to the hydraulic oil tank.

The control valve 175L is a spool valve that switches the flow of hydraulic oil to supply hydraulic oil discharged by the left main pump 14L to the boom cylinder 7. The control valve 175R is a spool valve that switches the flow of hydraulic oil to supply hydraulic oil discharged by the right main pump 14R to the boom cylinder 7 and to discharge hydraulic oil in the boom cylinder 7 to the hydraulic oil tank.

The control valve 176L is a spool valve that switches the flow of hydraulic oil to supply hydraulic oil discharged by the left main pump 14L to the arm cylinder 8 and to discharge hydraulic oil in the arm cylinder 8 to the hydraulic oil tank.

The control valve 176R is a spool valve that switches the flow of hydraulic oil to supply hydraulic oil discharged by the right main pump 14R to the arm cylinder 8 and to discharge hydraulic oil in the arm cylinder 8 to the hydraulic oil tank.

The left parallel conduit 42L is a hydraulic oil line running parallel to the left center bypass conduit 40L. When the flow of hydraulic oil through the left center bypass conduit 40L is restricted or blocked by any of the control valves 171, 173 and 175L, the left parallel conduit 42L can supply hydraulic oil to a control valve further downstream. The right parallel conduit 42R is a hydraulic oil line running parallel to the right center bypass conduit 40R. When the flow of hydraulic oil through the right center bypass conduit 40R is restricted or blocked by any of the control valves 172, 174 and 175R, the right parallel conduit 42R can supply hydraulic oil to a control valve further downstream.

The regulator 13 includes a left regulator 13L and a right regulator 13R. The left regulator 13L controls the discharge quantity of the left main pump 14L by adjusting the swash plate tilt angle of the left main pump 14L in accordance with the discharge pressure of the left main pump 14L. Specifically, the left regulator 13L, for example, reduces the discharge quantity of the left main pump 14L by adjusting its swash plate tilt angle according as the discharge pressure of the left main pump 14L increases. The same is the case with the right regulator 13R. This is for preventing the absorbed power (absorbed horsepower) of the main pump 14, expressed as the product of discharge pressure and discharge quantity, from exceeding the output power (for example, the output horsepower) of the engine 11.

The operating device 26 includes a left operating lever 26L, a right operating lever 26R, and travel levers 26D. The travel levers 26D include a left travel lever 26DL and a right travel lever 26DR.

The left operating lever 26L is used for swing operation and for operating the arm 5. The left operating lever 26L is operated forward or backward to apply a control pressure commensurate with the amount of lever operation to a pilot port of the control valve 176, using hydraulic oil discharged by the pilot pump 15, and is operated rightward or leftward to apply a pilot pressure commensurate with the amount of lever operation to a pilot port of the control valve 173, using hydraulic oil discharged by the pilot pump 15.

Specifically, the left operating lever 26L is operated in an arm closing direction to introduce hydraulic oil to the right pilot port of the control valve 176L and introduce hydraulic oil to the left pilot port of the control valve 176R. Furthermore, the left operating lever 26L is operated in an arm opening direction to introduce hydraulic oil to the left pilot port of the control valve 176L and introduce hydraulic oil to the right pilot port of the control valve 176R. Furthermore, the left operating lever 26L is operated in a counterclockwise swing direction to introduce hydraulic oil to the left pilot port of the control valve 173, and is operated in a clockwise swing direction to introduce hydraulic oil to the right pilot port of the control valve 173.

The right operating lever 26R is used to operate the boom 4 and operate the bucket 6. The right operating lever 26R is operated forward or backward to apply a control pressure commensurate with the amount of lever operation to a pilot port of the control valve 175, using hydraulic oil discharged by the pilot pump 15. The right operating lever 26R is operated rightward or leftward to apply a control pressure commensurate with the amount of lever operation to a pilot port of the control valve 174, using hydraulic oil discharged by the pilot pump 15.

Specifically, the right operating lever 26R is operated in a boom lowering direction to introduce hydraulic oil to the right pilot port of the control valve 175R. Furthermore, the right operating lever 26R is operated in a boom raising direction to introduce hydraulic oil to the right pilot port of the control valve 175L and introduce hydraulic oil to the left pilot port of the control valve 175R. The right operating lever 26R is operated in a bucket closing direction to introduce hydraulic oil to the left pilot port of the control valve 174, and is operated in a bucket opening direction to introduce hydraulic oil to the right pilot port of the control valve 174.

The travel levers 26D are used to operate the crawler 1C. Specifically, the left travel lever 26DL is used to operate the left crawler 1CL. The left travel lever 26DL may be configured to operate together with a left travel pedal. The left travel lever 26DL is operated forward or backward to apply a control pressure commensurate with the amount of lever operation to a pilot port of the control valve 171, using hydraulic oil discharged by the pilot pump 15. The right travel lever 26DR is used to operate the right crawler 1CR. The right travel lever 26DR may be configured to operate together with a right travel pedal. The right travel lever 26DR is operated forward or backward to apply a control pressure commensurate with the amount of lever operation to a pilot port of the control valve 172, using hydraulic oil discharged by the pilot pump 15.

The discharge pressure sensor 28 includes a discharge pressure sensor 28L and a discharge pressure sensor 28R. The discharge pressure sensor 28L detects the discharge pressure of the left main pump 14L, and outputs a detected value to the controller 30. The same is the case with the discharge pressure sensor 28R.

The operating pressure sensor 29 includes operating pressure sensors 29LA, 29LB, 29RA, 29RB, 29DL and 29DR. The operating pressure sensor 29LA detects the details of the operator's forward or backward operation on the left operating lever 26L in the form of pressure, and outputs a detected value to the controller 30. Examples of the details of operation include the direction of lever operation and the amount of lever operation (the angle of lever operation).

Likewise, the operating pressure sensor 29LB detects the details of the operator's rightward or leftward operation on the left operating lever 26L in the form of pressure, and outputs a detected value to the controller 30. The operating pressure sensor 29RA detects the details of the operator's forward or backward operation on the right operating lever 26R in the form of pressure, and outputs a detected value to the controller 30. The operating pressure sensor 29RB detects the details of the operator's rightward or leftward operation on the right operating lever 26R in the form of pressure, and outputs a detected value to the controller 30. The operating pressure sensor 29DL detects the details of the operator's forward or backward operation on the left travel lever 26DL in the form of pressure, and outputs a detected value to the controller 30. The operating pressure sensor 29DR detects the details of the operator's forward or backward operation on the right travel lever 26DR in the form of pressure, and outputs a detected value to the controller 30.

The controller 30 receives the output of the operating pressure sensor 29, and outputs a control command to the regulator 13 to change the discharge quantity of the main pump 14 on an as-needed basis. Furthermore, the controller 30 receives the output of a control pressure sensor 19 provided upstream of a throttle 18, and outputs a control command to the regulator 13 to change the discharge quantity of the main pump 14 on an as-needed basis. The throttle 18 includes a left throttle 18L and a right throttle 18R. The control pressure sensor 19 includes a left control pressure sensor 19L and a right control pressure sensor 19R.

The left throttle 18L is placed between the most downstream control valve 176L and the hydraulic oil tank in the left center bypass conduit 40L. Therefore, the flow of hydraulic oil discharged by the left main pump 14L is restricted by the left throttle 18L. The left throttle 18L generates a control pressure for controlling the left regulator 13L. The left control pressure sensor 19L is a sensor for detecting this control pressure, and outputs a detected value to the controller 30. The controller 30 controls the discharge quantity of the left main pump 14L by adjusting the swash plate tilt angle of the left main pump 14L in accordance with this control pressure. The controller 30 decreases the discharge quantity of the left main pump 14L as this control pressure increases, and increases the discharge quantity of the left main pump 14L as this control pressure decreases. The discharge quantity of the right main pump 14R is controlled in the same manner.

Specifically, in the case of a standby state where none of the actuators is operated in the shovel 100 as illustrated in FIG. 2, hydraulic oil discharged by the left main pump 14L arrives at the left throttle 18L through the left center bypass conduit 40L. The flow of hydraulic oil discharged by the left main pump 14L increases the control pressure generated upstream of the left throttle 18L. As a result, the controller 30 decreases the discharge quantity of the left main pump 14L to a minimum allowable discharge quantity to reduce pressure loss (pumping loss) during passage of the hydraulic oil discharged by the left main pump 14L through the left center bypass conduit 40L. In contrast, when any of the hydraulic actuators is operated, hydraulic oil discharged by the left main pump 14L flows into the operated hydraulic actuator via a control valve corresponding to the operated hydraulic actuator. The flow rate of hydraulic oil discharged by the left main pump 14L and arriving at the left throttle 18L decreases or disappears to reduce the control pressure generated upstream of the left throttle 18L. As a result, the controller 30 increases the discharge quantity of the left main pump 14L to cause sufficient hydraulic oil to flow into the operated hydraulic actuator to ensure driving of the operated hydraulic actuator. The controller 30 controls the discharge quantity of the right main pump 14R in the same manner.

According to the above-described configuration, the hydraulic system of FIG. 2 can control unnecessary energy consumption with respect to the main pump 14 in the standby state. The unnecessary energy consumption includes pumping loss that hydraulic oil discharged by the main pump 14 causes in the center bypass conduit 40. Furthermore, in the case of actuating a hydraulic actuator, the hydraulic system of FIG. 2 can ensure that necessary and sufficient hydraulic oil is supplied from the main pump 14 to the hydraulic actuator to be actuated.

Figure 3A:
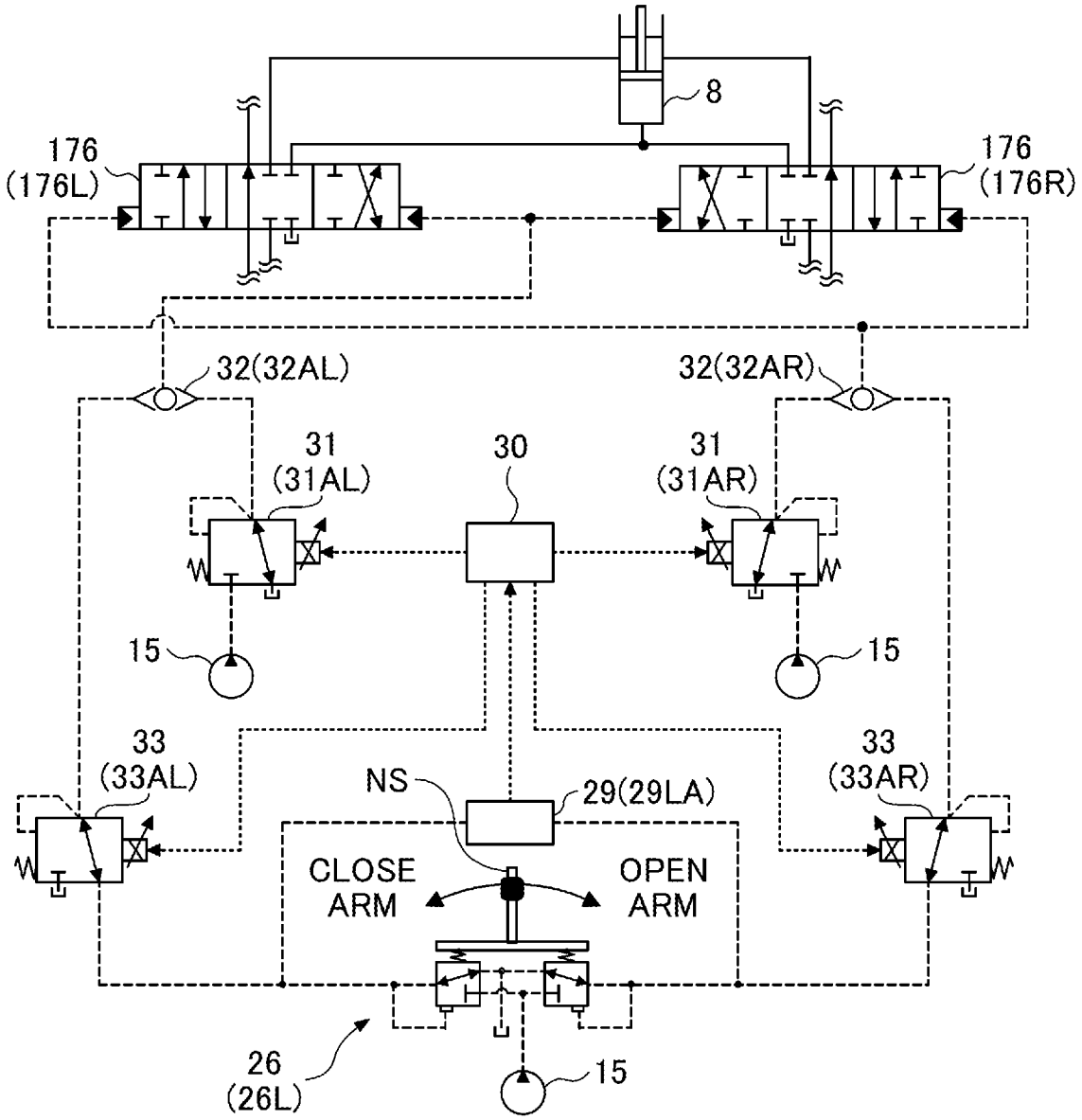
FIG. 3A is a diagram of part of the hydraulic system related to the operation of an arm cylinder.
Figure 3B:
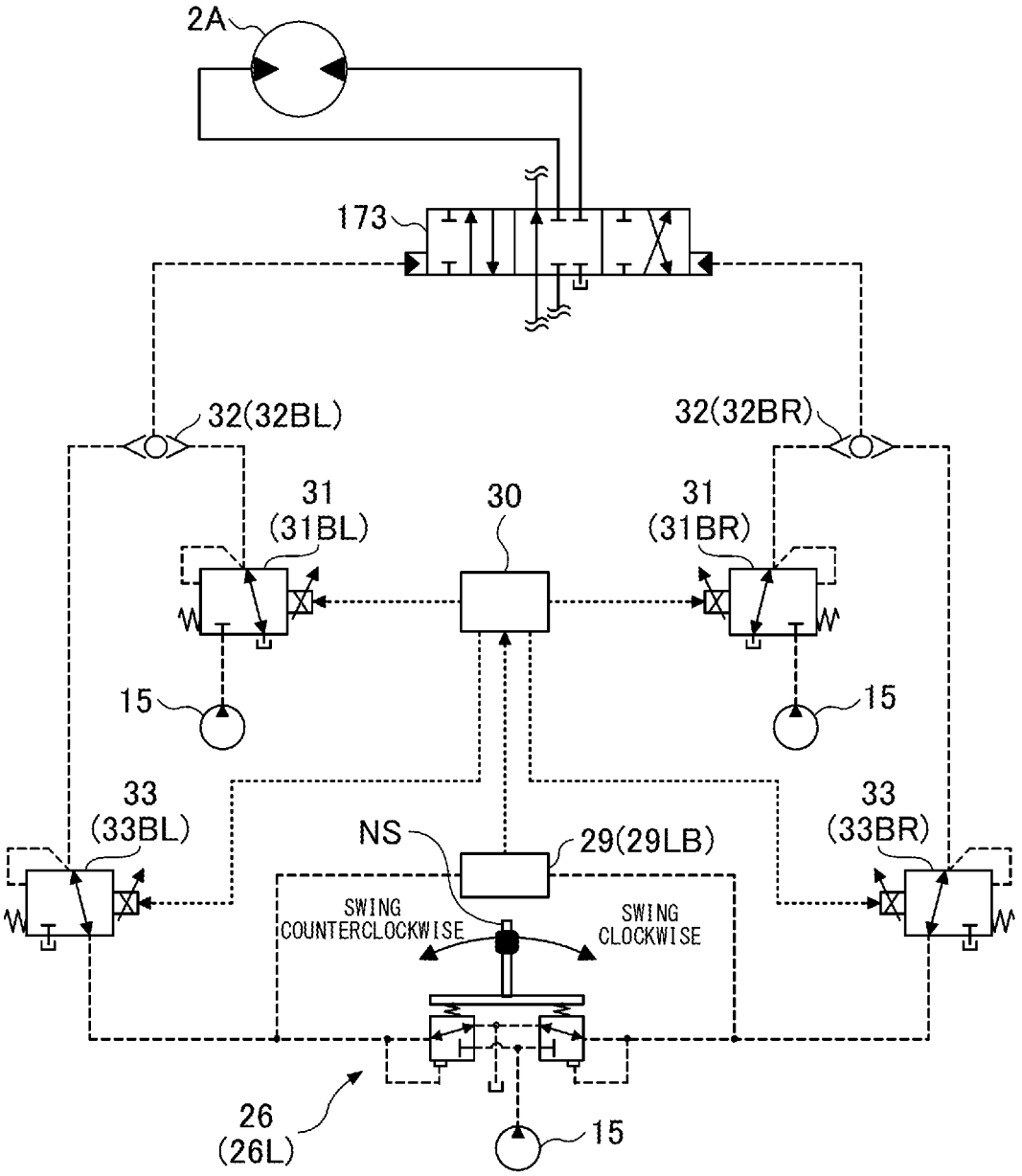
FIG. 3B is a diagram of part of the hydraulic system related to the operation of a swing hydraulic motor.
Figure 3C:
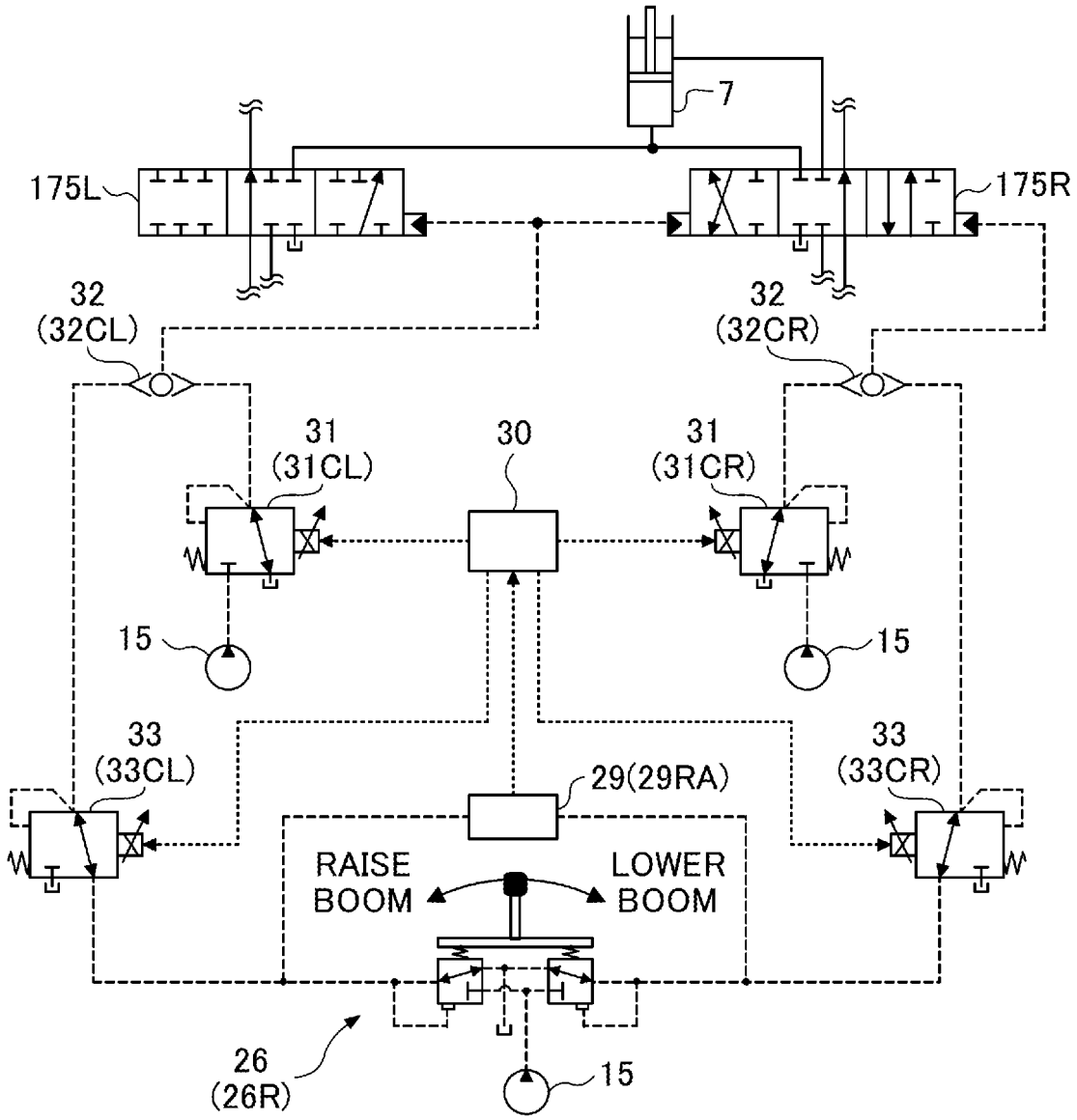
FIG. 3C is a diagram of part of the hydraulic system related to the operation of a boom cylinder.
Figure 3D:
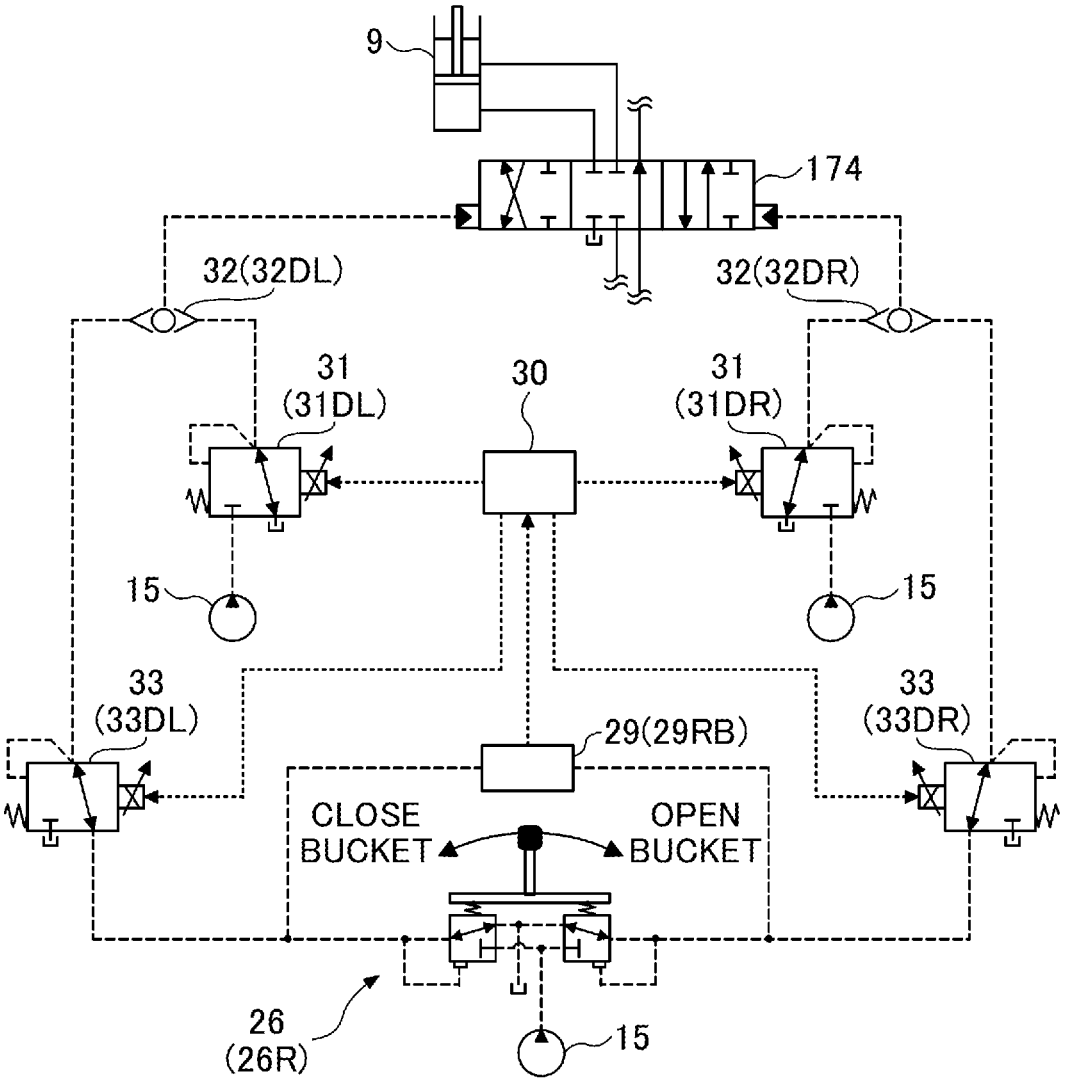
FIG. 3D is a diagram of part of the hydraulic system related to the operation of a bucket cylinder.

Next, configurations for the controller 30 automatically operating actuators with the machine control function are described with reference to FIGS. 3A through 3D. FIGS. 3A through 3D are diagrams of part of the hydraulic system. Specifically, FIG. 3A is a diagram of part of the hydraulic system related to the operation of the arm cylinder 8. FIG. 3B is a diagram of part of the hydraulic system related to the operation of the swing hydraulic motor 2A. FIG. 3C is a diagram of part of the hydraulic system related to the operation of the boom cylinder 7. FIG. 3D is a diagram of part of the hydraulic system related to the operation of the bucket cylinder 9.

As illustrated in FIGS. 3A through 3D, the hydraulic system includes a proportional valve 31, a shuttle valve 32, and a proportional valve 33. The proportional valve 31 includes proportional valves 31AL through 31DL and 31AR through 31DR. The shuttle valve 32 includes shuttle valves 32AL through 32DL and 32AR through 32DR. The proportional valve 33 includes proportional valves 33AL through 33DL and 33AR through 33DR.

The proportional valve 31 is configured to operate as a control valve for machine control. The proportional valve 31 is placed in a conduit connecting the pilot pump 15 and the shuttle valve 32, and is configured to be able to change the flow area of the conduit. According to this embodiment, the proportional valve 31 operates in response to a control command output by the controller 30. Therefore, the controller 30 can supply hydraulic oil discharged by the pilot pump 15 to a pilot port of a corresponding control valve in the control valve unit 17 via the proportional valve 31 and the shuttle valve 32 independent of the operator's operation on the operating device 26.

The shuttle valve 32 includes two inlet ports and one outlet port. Of the two inlet ports, one is connected to the operating device 26 and the other is connected to the proportional valve 31. The outlet port is connected to a pilot port of a corresponding control valve in the control valve unit 17. Therefore, the shuttle valve 32 can apply the higher one of a pilot pressure generated by the operating device 26 and a pilot pressure generated by the proportional valve 31 to the pilot port of the corresponding control valve.

Like the proportional valve 31, the proportional valve 33 is configured to operate as a control valve for machine control. The proportional valve 33 is placed in a conduit connecting the operating device 26 and the shuttle valve 32. According to this embodiment, the proportional valve 33 operates in response to a control command output by the controller 30. Therefore, the controller 30 can supply hydraulic oil discharged by the operating device 26, after reducing its pressure, to a pilot port of a corresponding control valve in the control valve unit 17 via the shuttle valve 32, independent of the operator's operation on the operating device 26.

This configuration enables the controller 30 to operate a hydraulic actuator corresponding to a specific operating device 26 even when the specific operating device 26 is not operated. Furthermore, the controller 30 can force a hydraulic actuator corresponding to a specific operating device 26 to stop operating even when the specific operating device 26 is being operated.

For example, as illustrated in FIG. 3A, the left operating lever 26L is used to operate the arm 5. Specifically, the left operating lever 26L uses hydraulic oil discharged by the pilot pump 15 to apply a pilot pressure commensurate with a forward or backward operation to a pilot port of the control valve 176. More specifically, the left operating lever 26L is operated in the arm closing direction (backward direction) to apply a pilot pressure commensurate with the amount of operation to the right pilot port of the control valve 176L and the left pilot port of the control valve 176R. Furthermore, the left operating lever 26L is operated in the arm opening direction (forward direction) to apply a pilot pressure commensurate with the amount of operation to the left pilot port of the control valve 176L and the right pilot port of the control valve 176R.

The left operating lever 26L is provided with a switch NS. According to this embodiment, the switch NS is a push button switch. The operator can operate the left operating lever 26L with a hand while pressing the switch NS with a finger. The switch NS may also be provided on the right operating lever 26R or at a different position in the cabin 10.

The operating pressure sensor 29LA detects the details of the operator's forward or backward operation on the left operating lever 26L in the form of pressure, and outputs a detected value to the controller 30.

The proportional valve 31AL operates in response to a current command output by the controller 30. The proportional valve 31AL controls a pilot pressure generated by hydraulic oil introduced to the right pilot port of the control valve 176L and the left pilot port of the control valve 176R from the pilot pump 15 through the proportional valve 31AL and the shuttle valve 32AL. The proportional valve 31AR operates in response to a current command output by the controller 30. The proportional valve 31AR controls a pilot pressure generated by hydraulic oil introduced to the left pilot port of the control valve 176L and the right pilot port of the control valve 176R from the pilot pump 15 through the proportional valve 31AR and the shuttle valve 32AR. The proportional valve 31AL can adjust the pilot pressure such that the control valve 176L can stop at a desired valve position. Furthermore, the proportional valve 31AR can adjust the pilot pressure such that the control valve 176R can stop at a desired valve position.

According to this configuration, the controller 30 can supply hydraulic oil discharged by the pilot pump 15 to the right pilot port of the control valve 176L and the left pilot port of the control valve 176R through the proportional valve 31AL and the shuttle valve 32AL, independent of the operator's arm closing operation. That is, the controller 30 can automatically close the arm 5. Furthermore, the controller 30 can supply hydraulic oil discharged by the pilot pump 15 to the left pilot port of the control valve 176L and the right pilot port of the control valve 176R through the proportional valve 31AR and the shuttle valve 32AR, independent of the operator's arm opening operation. That is, the controller 30 can automatically open the arm 5.

The proportional valve 33AL operates in response to a control command (a current command) output by the controller 30, and reduces a pilot pressure generated by hydraulic oil introduced to the right pilot port of the control valve 176L and the left pilot port of the control valve 176R from the pilot pump 15 through the left operating lever 26L, the proportional valve 33AL, and the shuttle valve 32AL. The proportional valve 33AR operates in response to a control command (a current command) output by the controller 30, and reduces a pilot pressure generated by hydraulic oil introduced to the left pilot port of the control valve 176L and the right pilot port of the control valve 176R from the pilot pump 15 through the left operating lever 26L, the proportional valve 33AR, and the shuttle valve 32AR. The proportional valves 33AL and 33AR can adjust the pilot pressures such that the control valves 176L and 176R can stop at desired valve positions, respectively.

According to this configuration, even when the operator is performing an arm closing operation, the controller 30 can reduce a pilot pressure applied to the closing-side pilot port of the control valve 176 (the left pilot port of the control valve 176L and the right pilot port of the control valve 176R) to force the arm 5 to stop closing on an as-needed basis. The same is true for the case of forcing the arm 5 to stop opening while the operator is performing an arm opening operation.

The controller 30 may also force the arm 5 to stop closing by forcing the control valve 176 to return to a neutral position by controlling the proportional valve 31AR to increase a pilot pressure applied to the opening-side pilot port of the control valve 176 (the right pilot port of the control valve 176L and the left pilot port of the control valve 176R), which is on the opposite side from the closing-side pilot port of the control valve 176, on an as-needed basis, even when the operator is performing an arm closing operation. In this case, the proportional valve 33A1 may be omitted. The same is true for the case of forcing the arm 5 to stop opening while the operator is performing an arm opening operation.

Furthermore, although a description with reference to FIGS. 3B through 3D is omitted, the same is true for the case of forcing the upper swing structure 3 to stop swinging while the operator is performing a swinging operation, the case of forcing the boom 4 to stop operating while the operator is performing a boom raising operation or a boom lowering operation, and forcing the bucket 6 to stop operating while the operator is performing a bucket closing operation or a bucket opening operation. Furthermore, the same is also true for the case of forcing the lower traveling structure 1 to stop traveling while the operator is performing a travel operation.

Furthermore, as illustrated in FIG. 3B, the left operating lever 26L is also used to operate the swing mechanism 2. Specifically, the left operating lever 26L applies a pilot pressure commensurate with a rightward or leftward operation to a pilot port of the control valve 173, using hydraulic oil discharged by the pilot pump 15. More specifically, when operated in the counterclockwise swing direction (leftward direction), the left operating lever 26L applies a pilot pressure commensurate with the amount of operation to the left pilot port of the control, valve 173. Furthermore, when operated in the clockwise swing direction (rightward direction), the left operating lever 26L applies a pilot pressure commensurate with the amount of operation to the right pilot port of the control valve 173.

The operating pressure sensor 29LB detects the details of the operator's rightward or leftward operation on the left operating lever 26L in the form of pressure, and outputs a detected value to the controller 30.

The proportional valve 31BL operates in response to a current command output by the controller 30. The proportional valve 31BL controls a pilot pressure generated by hydraulic oil introduced to the left pilot port of the control valve 173 from the pilot pump 15 through the proportional valve 31BL and the shuttle valve 32BL. The proportional valve 31BR operates in response to a current command output by the controller 30. The proportional valve 31BR controls a pilot pressure generated by hydraulic oil introduced to the right pilot port of the control valve 173 from the pilot pump 15 through the proportional valve 31BR and the shuttle valve 32BR. The proportional valves 31BL and 31BR can adjust the pilot pressures such that the control valve 173 can stop at a desired valve position.

According to this configuration, the controller 30 can supply hydraulic oil discharged by the pilot pump 15 to the left pilot port of the control valve 173 through the proportional valve 31BL and the shuttle valve 32BL, independent of the operator's counterclockwise swing operation. That is, the controller 30 can automatically swing the swing mechanism 2 counterclockwise. Furthermore, the controller 30 can supply hydraulic oil discharged by the pilot pump 15 to the right pilot port of the control valve 173 through the proportional valve 31BR and the shuttle valve 32BR, independent of the operator's clockwise swing operation. That is, the controller 30 can automatically swing the swing mechanism 2 clockwise.

Furthermore, as illustrated in FIG. 3C, the right operating lever 26R is used to operate the boom 4. Specifically, the right operating lever 26R applies a pilot pressure commensurate with a forward or backward operation to a pilot port of the control valve 175, using hydraulic oil discharged by the pilot pump 15. More specifically, when operated in the boom raising direction (backward direction), the right operating lever 26R applies a pilot pressure commensurate with the amount of operation to the right pilot port of the control valve 175L and the left pilot port of the control valve 175R. Furthermore, when operated in the boom lowering direction (forward direction), the right operating lever 26R applies a pilot pressure commensurate with the amount of operation to the right pilot port of the control valve 175R.

The operating pressure sensor 29RA detects the details of the operator's forward or backward operation on the right operating lever 26R in the form of pressure, and outputs a detected value to the controller 30.

The proportional valve 31CL operates in response to a current command output by the controller 30. The proportional valve 31CL controls a pilot pressure generated by hydraulic oil introduced to the right pilot port of the control valve 175L and the left pilot port of the control valve 175R from the pilot pump 15 through the proportional valve 31CL and the shuttle valve 32CL. The proportional valve 31CR operates in response to a current command output by the controller 30. The proportional valve 31CR controls a pilot pressure generated by hydraulic oil introduced to the right pilot port of the control valve 175R from the pilot pump 15 through the proportional valve 31CR and the shuttle valve 32CR. The proportional valve 31CL can adjust the pilot pressure such that the control valves 175L and 175R can stop at a desired valve position. The proportional valve 31CR can adjust the pilot pressure such that the control valve 175R can stop at a desired valve position.

According to this configuration, the controller 30 can supply hydraulic oil discharged by the pilot pump 15 to the right pilot port of the control valve 175L and the left pilot port of the control valve 175R through the proportional valve 31CL and the shuttle valve 32CL, independent of the operator's boom raising operation. That is, the controller 30 can automatically raise the boom 4. Furthermore, the controller 30 can supply hydraulic oil discharged by the pilot pump 15 to the right pilot port of the control valve 175R through the proportional valve 31CR and the shuttle valve 32CR, independent of the operator's boom lowering operation. That is, the controller 30 can automatically lower the boom 4.

Furthermore, as illustrated in FIG. 3D, the right operating lever 26R is also used to operate the bucket 6. Specifically, the right operating lever 26R applies a pilot pressure commensurate with a rightward or leftward operation to a pilot port of the control valve 174, using hydraulic oil discharged by the pilot pump 15. More specifically, when operated in the bucket closing direction (leftward direction), the right operating lever 26R applies a pilot pressure commensurate with the amount of operation to the left pilot port of the control valve 174. Furthermore, when operated in the bucket opening direction (rightward direction), the right operating lever 26R applies a pilot pressure commensurate with the amount of operation to the right pilot port of the control valve 174.

The operating pressure sensor 29RB detects the details of the operator's rightward or leftward operation of the right operating lever 26R in the form of pressure, and outputs a detected value to the controller 30.

The proportional valve 31DL operates in response to a current command output by the controller 30. The proportional valve 31DL controls a pilot pressure generated by hydraulic oil introduced to the left pilot port of the control valve 174 from the pilot pump 15 through the proportional valve. 31DL and the shuttle valve 32DL. The proportional valve 31DR operates in response to a current command output by the controller 30. The proportional valve 31DR controls a pilot pressure generated by hydraulic oil introduced to the right pilot port of the control valve 174 from the pilot pump 15 through the proportional valve 31DR and the shuttle valve 32DR. The proportional valves 31DL and 31DR can adjust the pilot pressures such that the control valve 174 can stop at a desired valve position.

According to this configuration, the controller 30 can supply hydraulic oil discharged by the pilot pump 15 to the left pilot port of the control valve 174 through the proportional valve 31DL and the shuttle valve 32DL, independent of the operator's bucket closing operation. That is, the controller 30 can automatically close the bucket 6. Furthermore, the controller 30 can supply hydraulic oil discharged by the pilot pump 15 to the right pilot port of the control valve 174 through the proportional valve 31DR and the shuttle valve 32DR, independent of the operator's bucket opening operation. That is, the controller 30 can automatically open the bucket 6.

The shovel 100 may also be configured to cause the lower traveling structure 1 to automatically travel forward and backward. In this case, in the hydraulic system, a part related to the operation of the left travel hydraulic motor 2ML and a part related to the operation of the right travel hydraulic motor 2MR may be configured the same as a part related to the operation of the boom cylinder 7, etc.

Figure 4:
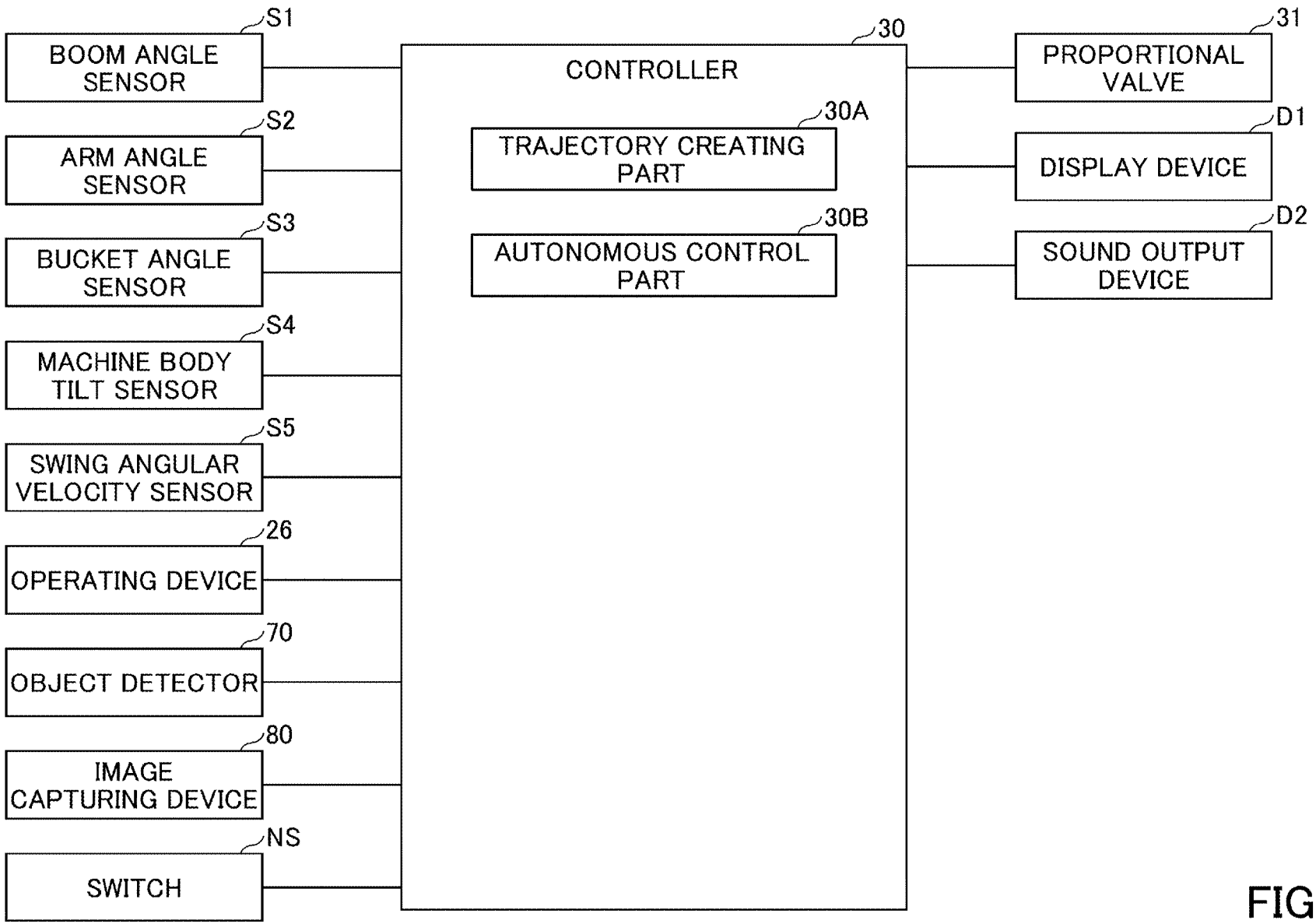
FIG. 4 is a functional block diagram of a controller.

Next, functions of the controller 30 are described with reference to FIG. 4. FIG. 4 is a functional block diagram of the controller 30. According to the example of FIG. 4, the controller 30 is configured to be able to receive signals output by the pose detector, the operating device 26, the object detector 70, the image capturing device 80, the switch NS, etc., to execute various operations to output control commands to the proportional valve 31, the display device D1, the sound output device D2, etc. The pose detector includes, for example, the boom angle sensor S1, the arm angle sensor S2, the bucket angle sensor S3, the machine body tilt sensor S4, and the swing angular velocity sensor S5. The controller 30 includes a trajectory creating part 30A and an autonomous control part 30B as functional blocks. The functional elements may be either constituted of hardware or constituted of software.

The trajectory creating part 30A is configured to create a target trajectory that is a trajectory drawn by a predetermined part of the shovel 100 when the shovel 100 is caused to autonomously operate. The predetermined part is, for example, the teeth tips of the bucket 6, a predetermined point on the back surface of the bucket 6, or the like. According to this embodiment, the trajectory creating part 30A creates a target trajectory that the autonomous control part 30B uses when causing the shovel 100 to autonomously operate. Specifically, the trajectory creating part 30A creates a target trajectory based on the output of at least one of the object detector 70 and the image capturing device 80.

The autonomous control part 30B is configured to cause the shovel 100 to autonomously operate. According to this embodiment, the autonomous control part 30B is configured to move the predetermined part of the shovel 100 along a target trajectory created by the trajectory creating part 30A when a predetermined start condition is satisfied. Specifically, when the operating device 26 is operated with the switch NS being pressed, the autonomous control part 30B causes the shovel 100 to autonomously operate such that the predetermined part of the shovel 100 moves along a target trajectory. For example, when the left operating lever 26L is operated in the arm opening direction with the switch NS being pressed, the autonomous control part 30B causes the excavation attachment AT to autonomously operate such that the teeth tips of the bucket 6 move along a target trajectory.

Figure 5:
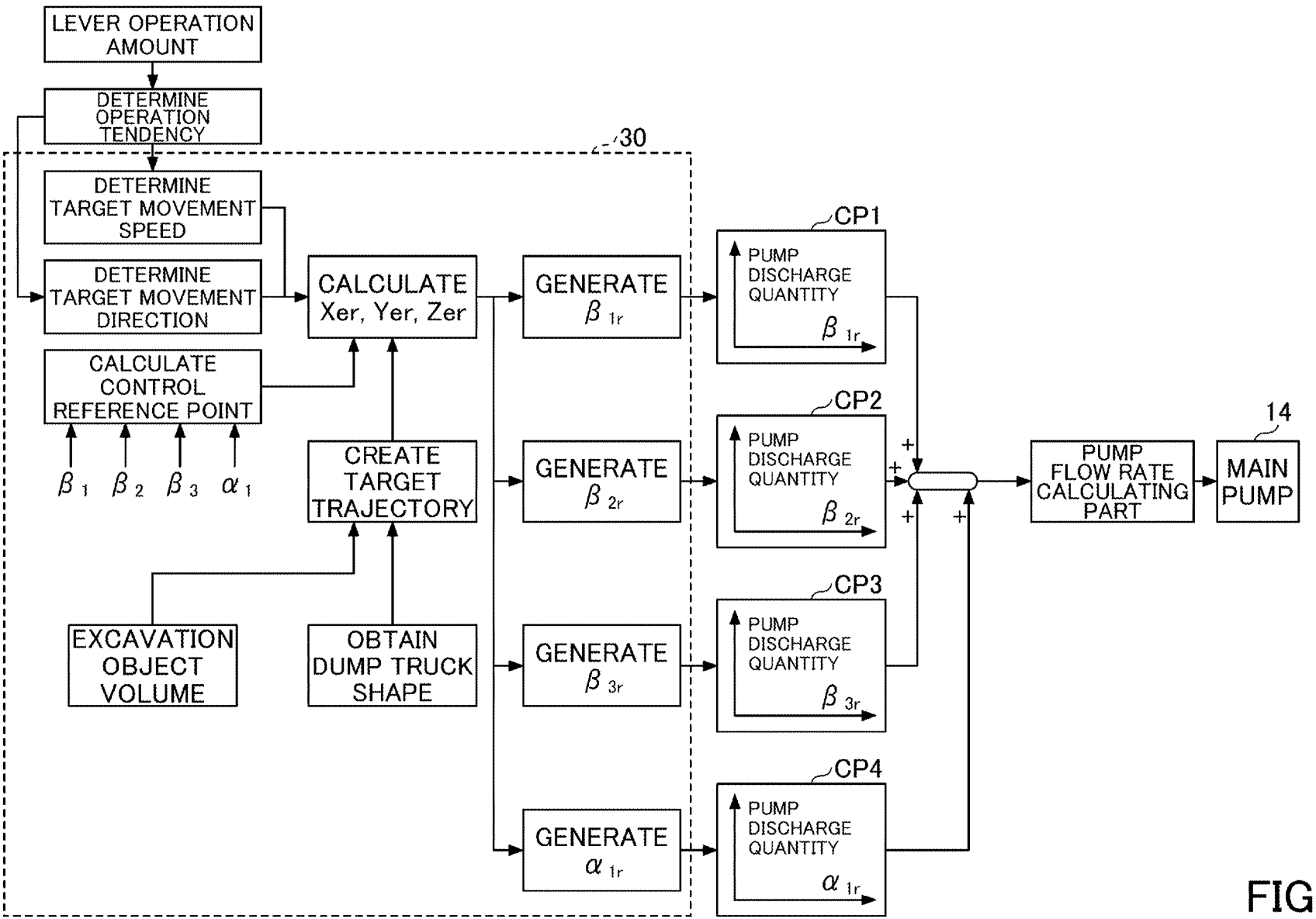
FIG. 5 is a block diagram of an autonomous control function.
Figure 6:
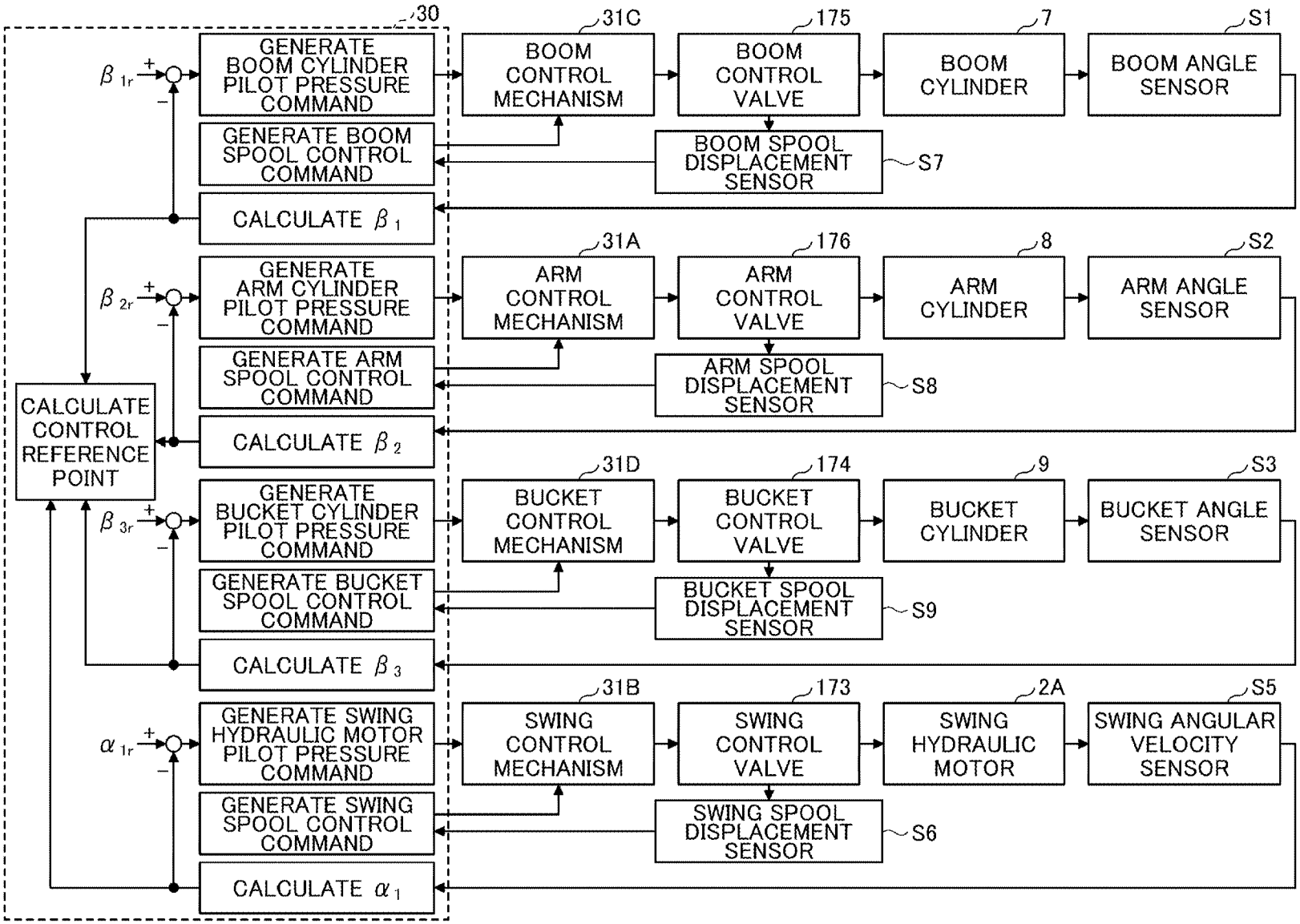
FIG. 6 is a block diagram of the autonomous control function.

Next, an example of a function of the controller 30 to autonomously control the movement of the attachment (hereinafter "autonomous control function") is described with reference to FIGS. 5 and 6. FIGS. 5 and 6 are block diagrams of the autonomous control function.

First, as illustrated in FIG. 5, the controller. 30 determines a target movement speed and a target movement direction based on an operation tendency. The operation tendency is determined based on the amount of lever operation, for example. The target movement speed is the target value of the movement speed of a control reference point. The target movement direction is the target value of the movement direction of the control reference point. The control reference point is, for example, the teeth tips of the bucket 6, a predetermined point on the buck surface of the bucket 6, a predetermined point on a bucket pin (the connection of the arm 5 and the bucket 6), or the like. The control reference point is calculated based on a boom angle $\beta_1$, an arm angle $\beta_2$, a bucket angle $\beta_3$, and a swing angle $\alpha_1$, for example.

Thereafter, the controller 30 calculates the three-dimensional coordinates (Xer, Yer, Zer) of the control reference point after passage of a unit time based on the target movement speed, the target movement direction, and the three-dimensional coordinates (Xe, Ye, Ze) of the control reference point. The three-dimensional coordinates (Xer, Yer, Zer) of the control reference point after passage of a unit time are, for example, coordinates on a target trajectory. The unit time is, for example, a time corresponding to an integer multiple of a control interval.

The target trajectory may be, for example, a target trajectory for a dumping operation (an earth discharging operation) executed in loading work that is the work of loading a dump truck with earth or the like. The dumping operation includes the operation of dumping (unloading) an excavation object such as earth scooped into the bucket 6 onto the bed of the dump truck. Typically, the dumping operation is a complex operation including bucket opening and arm opening. In this case, the target trajectory may be calculated based on at least one of the shape of the dump truck (for example, the length of the bed of the dump truck in its longitudinal direction and the orientation of the bed), the shape of a load such as earth already loaded onto the bed of the dump truck, the volume of the excavation object scooped into the bucket 6, etc., for example. The shape of the dump truck, the shape of the load, and the volume of the excavation object scooped into the bucket 6 may be derived based on the output of at least one of the object detector 70 and the image capturing device 80, for example.

For example, the target trajectory is set such that when the excavation object scooped into the bucket 6 is dumped onto the bed of the dump truck, the height of a load newly formed by the excavation object is substantially constant. Specifically, the target trajectory is set such that a substantially cuboid load having a width Wt, a length Lt, and a height Ht is formed.

Typically, the target trajectory is calculated before the start of a dumping operation and remains unchanged until the end of the dumping operation. The target trajectory, however, may be changed during execution of a dumping operation. For example, the target trajectory may be adjusted to be lower when the height of a newly formed load is greater than a desired height. That is, the target trajectory is typically controlled with open-loop control, but may be subjected to feedback control according to the height of a newly formed load. The height of a newly formed load is calculated based on the output of at least one of the object detector 70 and the image capturing device 80, for example.

Thereafter, the controller 30 generates command values $\beta_{1r}$, $\beta_{2r}$, and $\beta_{3r}$, for the pivoting of the boom 4, the arm 5, and the bucket 6 and a command value $\alpha_{1r}$ for the swinging of the upper swing structure 3 based on the calculated three-dimensional coordinates (Xer, Yer, Zer). The command value lair represents the boom angle $\beta_1$ when the control reference point can be caused to coincide with the three-dimensional coordinates (Xer, Yer, Zer), for example. Likewise, the command value $\beta_{2r}$ represents the arm angle $\beta_2$ when the control reference point can be caused to coincide with the three-dimensional coordinates (Xer, Yer, Zer), the command value $\beta_{3r}$ represents the bucket angle $\beta_3$ when the control reference point can be caused to coincide with the three-dimensional coordinates (Xer, Yer, Zer), and the command value $\alpha_{1r}$ represents the swing angle $\alpha_1$ when the control reference point can be caused to coincide with the three-dimensional coordinates (Xer, Yer, Zer).

The command value $\beta_{3r}$ for the pivoting of the bucket 6 may be changed during execution of a dumping operation. For example, when the height of a newly formed load is greater than a desired height, the command value $\beta_{3r}$ may be adjusted to be smaller. That is, the command value $\beta_{3r}$ is typically controlled with open-loop control, but may be subjected to feedback control according to the height of a newly formed load.

When a target trajectory for a dumping operation is calculated, typically, the generation of the command value $\alpha_{1r}$ is omitted. This is because the dumping operation is typically performed with the swing angle $\alpha_1$ being fixed.

Thereafter, as illustrated in FIG. 6, the controller 30 causes the boom cylinder 7, the arm cylinder 8, the bucket cylinder 9, and the swing hydraulic motor 2A to operate so that the boom angle $\beta_1$, the arm angle $\beta_2$, the bucket angle $\beta_3$, and the swing angle $\alpha_1$ become the generated command values $\beta_{1r}$, $\beta_{2r}$, $\beta_{3r}$, and $\alpha_{1r}$, respectively. The swing angle $\alpha_1$ is calculated based on the output of the swing angular velocity sensor S5, the dimensions of parts of the shovel 100 measured and input in advance, etc., for example.

Specifically, the controller 30 generates a boom cylinder pilot pressure command corresponding to a difference $\Delta\beta_1$ between the current value and the command value $\beta_{1r}$ of the boom angle $\beta_1$, and outputs a control current corresponding to the boom cylinder pilot pressure command to a boom control mechanism 31C. The boom control mechanism 31C is configured to be able to apply a pilot pressure commensurate with the control current corresponding to the boom cylinder pilot pressure command to the control valve 175 serving as a boom control valve. The boom control mechanism 31C may be, for example, the proportional valve 31CL and the proportional valve 31CR in FIG. 3C.

Thereafter, receiving the pilot pressure generated by the boom control mechanism 31C, the control valve 175 causes hydraulic oil discharged by the main pump 14 to flow into the boom cylinder 7 with a flow direction and a flow rate corresponding to the pilot pressure.

At this point, the controller 30 may generate a boom spool control command based on the amount of spool displacement of the control valve 175 detected by a boom spool displacement sensor S7. The boom spool displacement sensor S7 is a sensor to detect the amount of displacement of the spool of the control valve 175. The controller 30 may output a control current corresponding to the boom spool control command to the boom control mechanism 31C. In this case, the boom control mechanism 31C applies a pilot pressure corresponding to the control current corresponding to the boom spool control command to the control valve 175.

The boom cylinder 7 extends and retracts with hydraulic oil supplied via the control valve 175. The boom angle sensor S1 detects the boom angle $\beta_1$ of the boom 4 moved by the extending or retracting boom cylinder 7.

Thereafter, the controller 30 feeds back the boom angle $\beta_1$ detected by the boom angle sensor S1 as the current value of the boom angle $\beta_1$ used in generating the boom cylinder pilot pressure command.

The above description, which relates to the operation of the boom 4 based on the command value $\beta_{1r}$, may also be likewise applied to the operation of the arm 5 based on the command value $\beta_{2r}$, the operation of the bucket 6 based on the command value $\beta_{3r}$, and the swing operation of the upper swing structure 3 based on the command value $\alpha_{1r}$. An arm control mechanism 31A is configured to be able to apply a pilot pressure commensurate with a control current corresponding to an arm cylinder pilot pressure command to the control valve 176 serving as an arm control valve. The arm control mechanism 31A may be, for example, the proportional valve 31AL and the proportional valve 31AR in FIG. 3A. Furthermore, a bucket control mechanism 31D is configured to be able to apply a pilot pressure commensurate with a control current corresponding to a bucket cylinder pilot pressure command to the control valve 174 serving as a bucket control valve. The bucket control mechanism 31D may be, for example, the proportional valve 31DL and the proportional valve 31DR in FIG. 3D. Furthermore, a swing control mechanism 31B is configured to be able to apply a pilot pressure commensurate with a control current corresponding to a swing hydraulic motor pilot pressure command to the control valve 173 serving as a swing control valve. The swing control mechanism 31B may be, for example, the proportional valve 31BL and the proportional valve 31BR in FIG. 3B. Furthermore, an arm spool displacement sensor. S8 is a sensor to detect the amount of displacement of the spool of the control valve 176; a bucket spool displacement sensor S9 is a sensor to detect the amount of displacement of the spool of the control valve 174, and a swing spool displacement sensor S6 is a sensor to detect the amount of displacement of the spool of the control valve 173.

As illustrated in FIG. 5, the controller 30 may derive pump discharge quantities from the command values $\beta_{1r}$, $\beta_{2r}$, $\beta_{3r}$, and $\alpha_{1r}$, using pump discharge quantity deriving parts CP1, CP2, CP3, and CP4. According to this embodiment, the pump discharge quantity deriving parts CP1, CP2, CP3, and CP4 derive pump discharge quantities from the command values $\beta_{1r}$, $\beta_{2r}$, $\beta_{3r}$, and $\alpha_{1r}$, using a pre-recorded reference table or the like. The pump discharge quantities derived by the pump discharge quantity deriving parts CP1, CP2, CP3, and CP4 are summed up to be input to a pump flow rate calculating part as a total pump discharge quantity. The pump flow rate calculating part controls the discharge quantity of the main pump 14 based on the input total pump discharge quantity. According to this embodiment, the pump flow rate calculating part controls the discharge quantity of the main pump 14 by changing the swash plate tilt angle of the main pump 14 according to the total pump discharge quantity.

Thus, the controller 30 can simultaneously control the respective openings of the control valve 175 serving as a boom control valve, the control valve 176 serving as an arm control valve, the control valve 174 serving as a bucket control valve, and the control valve 173 serving as a swing control valve and control the discharge quantity of the main pump 14. Therefore, the controller 30 can supply an appropriate amount of hydraulic oil to each of the boom cylinder 7, the arm cylinder 8, the bucket cylinder 9, and the swing hydraulic motor 2A.

The controller 30 performs the calculation of the three-dimensional coordinates (Xer, Yer, Zer), the generation of the command values $\beta_{1r}$, $\beta_{2r}$, $\beta_{3r}$, and $\alpha_{1r}$, and the determination of the discharge quantity of the main pump 14 as one control cycle, and executes autonomous control by repeating this control cycle. Furthermore, the controller 30 can improve the accuracy of the autonomous control by performing feedback control on the control reference point based on the respective outputs of the boom angle sensor S1, the arm angle sensor S2, the bucket angle sensor S3, and the swing angular velocity sensor S5. Specifically, the controller 30 can improve the accuracy of the autonomous control by performing feedback control on the flow rate of hydraulic oil flowing into each of the boom cylinder 7, the arm cylinder 8, the bucket cylinder 9, and the swing hydraulic motor 2A.

Furthermore, the controller 30 may also be configured to monitor the distance between the bucket 6 and a dump truck to prevent contact between the bucket 6 and the dump truck when executing autonomous control with respect to a dumping operation. For example, the controller 30 may stop the movement of the excavation attachment AT in response to determining, based on the outputs of the pose detector and the object detector 70, that the distance between each of one or more predetermined points on the back surface of the bucket 6 and the front panel of the dump truck falls below a predetermined value or that the distance between the teeth tips of the bucket 6 and the bottom surface of the bed of the dump truck falls below a predetermined value.

Figure 7A:
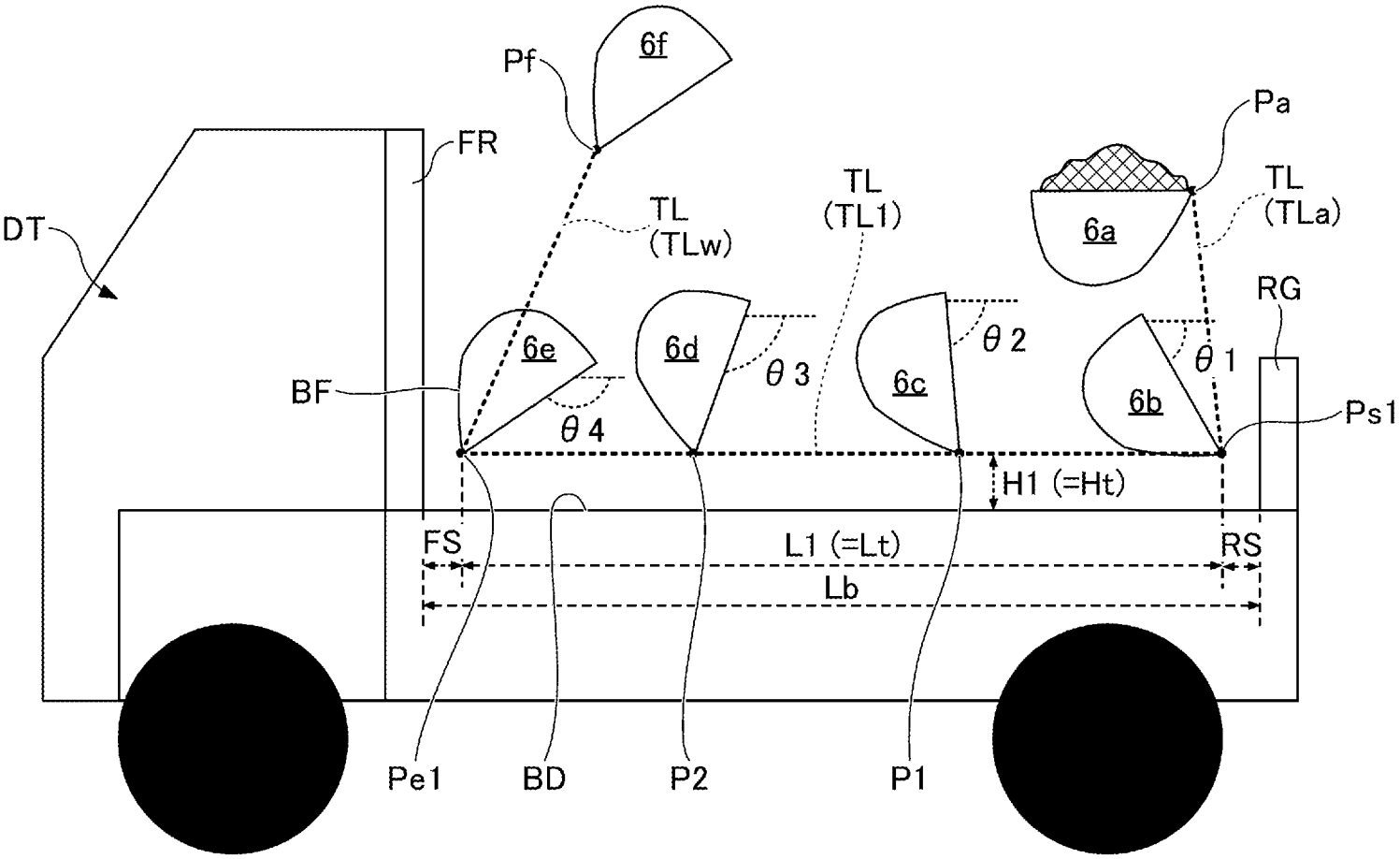
FIG. 7A is a side view of a bed of a dump truck when a dumping operation is performed.
Figure 7B:
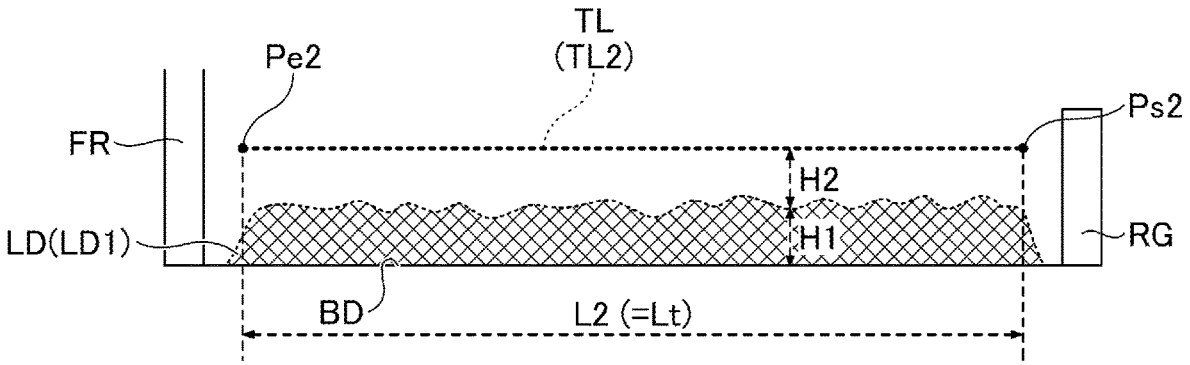
FIG. 7B is a side view of the bed of the dump truck when the dumping operation is performed.
Figure 7C:
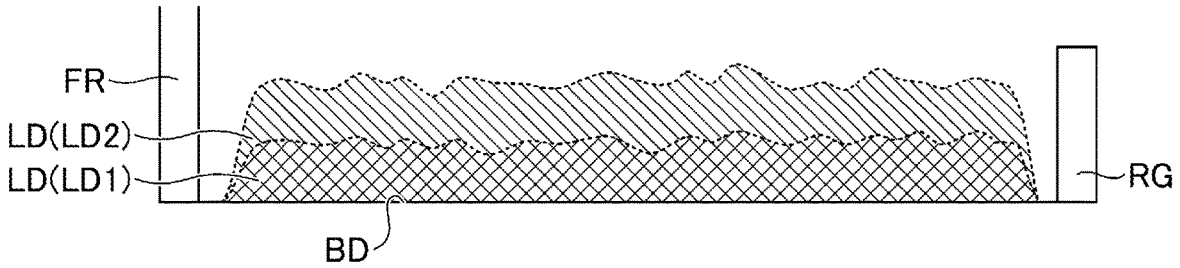
FIG. 7C is a side view of the bed of the dump truck when the dumping operation is performed.
Figure 7D:
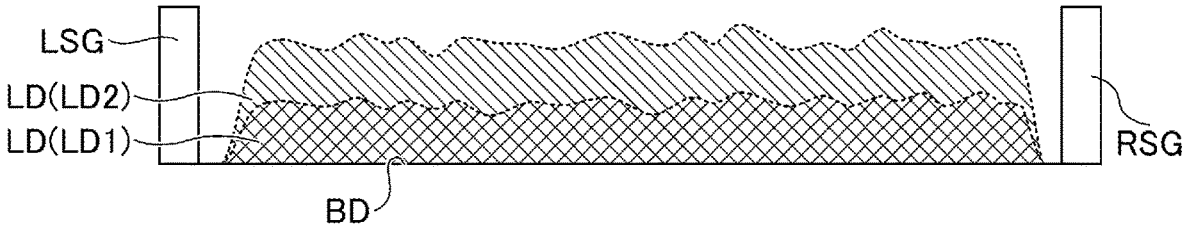
FIG. 7D is a rear view of the bed of the dump truck when the dumping operation is performed.

Next, an example of the autonomous control with respect to a dumping operation is described with reference to FIGS. 7A through 7D. FIGS. 7A through 7C are side views of a bed BD of a dump truck DT and FIG. 7D is a rear view of the bed BD when a dumping operation is performed. Specifically, FIG. 7A is a side view of the bed BD immediately before a dumping operation is performed. FIG. 7B is a side view of the bed BD immediately after the performance of the first dumping operation. FIG. 7C is a side view of the bed BD immediately after the performance of the second dumping operation. FIG. 7D is a rear view of the bed BD immediately after the performance of the second dumping operation.

In FIGS. 7A through 7C, a front panel FR and a rear gate RG of the dump truck DT are illustrated, while a depiction of a left side gate and a right side gate is omitted for clarification. In FIG. 7D, a left side gate LSG and a right side gate RSG are illustrated, while a depiction of the front panel FR and the rear gate RG is omitted for clarification. Furthermore, in FIGS. 7B through 7D, a depiction of the entire image of the dump truck DT is omitted.

Specifically, FIG. 7A illustrates the state of the bed BD of the dump truck DT where no excavation object such as earth is loaded at all. Furthermore, in FIG. 7A, the bucket 6 into which an excavation object is scooped and which is positioned above the bed BD by a manual operation or autonomous control is illustrated as a bucket 6*a*. Furthermore, the bucket 6*a* illustrates the state of the bucket 6 at the end of a boom raising and swing operation executed after an excavating operation. A point Pa represents the teeth tips position of the bucket 6 at the end of the boom raising and swing operation.

When the bed BD of the dump truck DT is recognized based on the output of at least one of the object detector 70 and the image capturing device 80, a dumping start point Ps1 and a dumping end point Pe1 are set. Thereafter, a target trajectory TL is determined as a virtual line segment connecting the dumping start point Ps1 and the dumping end point Pe1. Then, the opening angle of the bucket 6 is so calculated as to correspond to the position of this target trajectory TL. According to this, boom raising control and bucket opening control are executed such that the teeth tips of the bucket 6 are along the target trajectory TL, in response to arm opening control that is started when the teeth tips of the bucket 6 are at the dumping start point Ps1. Thereafter, when the arm 5 becomes perpendicular to the bed BD, the boom raising control switches to boom lowering control. That is, when the arm opening control is executed at a predetermined speed as master control, boom control and bucket control are executed in response as slave control. Thus, the teeth tips of the bucket 6 are controlled to move along the target trajectory TL. As master control, the bucket opening control may alternatively be executed. In this case, arm control and boom control are executed as slave control. At least one of the opening speed of the arm 5 and the opening speed of the bucket 6 may be changed based on at least one of an earth property, learning data for each work environment, etc.

A target trajectory TL1 for the first dumping operation is an example of the target trajectory TL, and is expressed as a virtual line segment connecting the dumping start point Ps1 and the dumping end point Pe1 at a height H1 from the bottom surface of the bed BD.

The dumping start point Ps1 is the start point of the target trajectory TL1. The dumping start point Ps1 is set at a position an interval RS apart from the rear gate RG in the forward direction. The value of the interval RS is prestored in the nonvolatile storage, for example. Furthermore, the dumping start point Ps1 is set in such a manner as to pass through the widthwise center of the bed BD.

The dumping end point Pe1 is the end point of the target trajectory TL1. The dumping end point Pe1 is set at a position an interval FS apart from the front panel FR in the backward direction. The value of the interval FS is prestored in the nonvolatile storage, for example. Furthermore, the dumping end point Pe1 is set in such a manner as to pass through the widthwise center of the bed BD.

A length L1 of the target trajectory TL1, which is the distance between the dumping start point Ps1 and the dumping end point Pe1, is an example of the length Lt, and is a value obtained by subtracting the interval RS and the interval FS from a bed length Lb of the dump truck DT.

The height H1 is an example of the height Ht, and is calculated based on the volume of the excavation object scooped into the bucket 6*a*, for example. Specifically, the height H1 is calculated such that the volume of a cuboid expressed as the product of the length Lt (L1), the height Ht (H1), and the width Wt is equal to the volume of the excavation object scooped into the bucket 6*a*. The width Wt is a value corresponding to the width of the bucket 6. The length Lt (L1) and the width Wt are calculated based on the output of at least one of the object detector 70 and the image capturing device 80. The length Lt (L1) and the width Wt may be prestored in the nonvolatile storage. The volume of the excavation object scooped into the bucket 6*a* is calculated based on the output of at least one of the object detector 70 and the image capturing device 80, for example.

The controller 30 causes the excavation attachment AT to autonomously operate such that the teeth tips of the bucket 6 serving as the control reference point move along the target trajectory TL1 thus calculated. Furthermore, the controller 30 executes the bucket opening control in accordance with the movement of the teeth tips of the bucket 6 along the target trajectory TL1.

The bucket opening control is a control to change the bucket angle $\beta_3$ such that the height of a load newly formed by the excavation object scooped into the bucket 6 (a cuboid extending along the target trajectory TL1) is maintained at the height H1.

The controller 30 typically executes the bucket opening control such that the bucket angle $\beta_3$ increases as the teeth tips of the bucket 6 approach the dumping end point Pe1. The controller 30 may take properties of the excavation object such as earth viscosity into account in determining the bucket angle $\beta_3$. Properties of the excavation object may be dynamically calculated based on the output of at least one of the object detector 70 and the image capturing device 80 or may be prestored in the nonvolatile storage.

A bucket 6*b* illustrates the state of the bucket 6 when the teeth tips of the bucket 6 are positioned at the dumping start point Ps1. The bucket angle $\beta_3$ at this time is an angle θ1. A bucket 6*c* illustrates the state of the bucket 6 when the teeth tips of the bucket 6 are positioned at a point P1 on the target trajectory TL1. The bucket angle $\beta_3$ at this time is an angle θ2 (>θ1). A bucket 6*d* illustrates the state of the bucket 6 when the teeth tips of the bucket 6 are positioned at a point P2 on the target trajectory TL1. The bucket angle $\beta_3$ at this time is an angle θ3 (>θ2). A bucket 6*e* illustrates the state of the bucket 6 when the teeth tips of the bucket 6 are positioned at the dumping end point Pe1. The bucket angle $\beta_3$ at this time is an angle θ4 (>θ3). A bucket 6*f* illustrates the state of the bucket 6 at the start of a boom lowering and swing operation that is performed after the dumping operation. Furthermore, a point Pf represents the teeth tips position of the bucket 6 at the start of the boom lowering and swing operation.

According to the example illustrated in FIGS. 7A through 7D, the controller 30 executes the bucket opening control such that a back surface BF of the bucket 6 when the teeth tips of the bucket 6 are positioned at the dumping end point Pe1 is parallel to the front panel FR or that the bucket angle $\beta_3$ is greater than the bucket angle θ4 at the time when the back surface BF of the bucket 6 is parallel to the front panel FR. This is for further ensuring the prevention of contact between the bucket 6 and the front panel FR.

FIG. 7B illustrates the state of the bed BD immediately after the performance of the first dumping operation. Specifically, FIG. 7B illustrates the shape of a load LD formed when the controller 30 executes the bucket opening control while moving the teeth tips of the bucket 6 along the target trajectory TL1, that is, the shape of a load LD1 formed by the first dumping operation. The load LD1 has substantially the same shape as a cuboid of the length L1, the width Wt, and the height H1. In FIG. 7B, the shape of the load LD1 formed by the first dumping operation is indicated by a cross pattern.

A target trajectory TL2 for the second dumping operation is an example of the target trajectory TL, and is expressed as a virtual line segment connecting a dumping start point Ps2 and a dumping end point Pe2 at a height H2 from the upper surface of the load LD1.

The height of the upper surface of the load LD1 relative to the bottom surface of the bed BD is calculated based on the output of at least one of the object detector 70 and the image capturing device 80, for example. The height of the upper surface of the load LD1 may be the height H1 calculated immediately before the first dumping operation.

The dumping start point Ps2 is the start point of the target trajectory TL2. The dumping start point Ps2 is set at a position the interval RS apart from the rear gate RG in the forward direction. The interval RS for the target trajectory TL2 may be a value different from the interval RS for the target trajectory TL1.

The dumping end point Pe2 is the end point of the target trajectory TL2. The dumping end point Pe2 is set at a position the interval FS apart from the front panel FR in the backward direction. The interval FS for the target trajectory TL2 may be a value different from the interval FS for the target trajectory TL1.

A length L2 of the target trajectory TL2, which is the distance between the dumping start point Ps2 and the dumping end point Pe2, is an example of the length Lt, and is a value obtained by subtracting the interval RS and the interval FS from the bed length Lb of the dump truck DT. The height H2 is an example of the height Ht, and is calculated based on the volume of the excavation object scooped into the bucket 6 immediately before the performance of the second dumping operation, for example. Specifically, the height H2 is calculated such that the volume of a cuboid expressed as the product of the length Lt (L2), the height Ht (H2), and the width Wt is equal to the volume of the excavation object scooped into the bucket 6 immediately before the performance of the second dumping operation.

The controller 30 causes the excavation attachment AT to autonomously operate such that the teeth tips of the bucket 6 move along the target trajectory TL2 thus calculated. Furthermore, the controller 30 executes the bucket opening control in accordance with the movement of the teeth tips of the bucket 6 along the target trajectory TL2.

FIGS. 7C and 7D illustrate the state of the bed BD immediately after the performance of the second dumping operation. Specifically, FIGS. 7C and 7D illustrate the shape of the load LD formed when the controller 30 executes the bucket opening control while moving the teeth tips of the bucket 6 along the target trajectory TL2, namely, a combination of the load LD1 formed by the first dumping operation and a load LD2 formed by the second dumping operation. The load LD2 has substantially the same shape as a cuboid of the length L2, the width Wt, and the height H2. In FIGS. 7C and 7D, the shape of the load LD2 formed by the second dumping operation is indicated by a pattern of downward diagonal lines.

The controller 30 creates the target trajectory TL for the third and subsequent dumping operations in the same manner. Specifically, the controller 30 creates the target trajectory TL for the next dumping operation if the total weight of the weight of the excavation object currently scooped into the bucket 6 and the weight of the load LD already loaded onto the bed BD of the dump truck DT is less than or equal to the maximum loading capacity of the dump truck DT. If the total weight exceeds the maximum loading capacity of the dump truck DT, the controller 30 does not create the target trajectory TL for the next dumping operation. That is, the controller 30 does not execute autonomous control with respect to the next dumping operation. This is because if the next dumping operation is performed, the weight of the load LD ultimately exceeds the maximum loading capacity of the dump truck DT. In this case, the controller 30 may so notify the operator using at least one of the display device D1 and the sound output device D2. The maximum loading capacity of the dump truck DT may be either a pre-input value or a value derived based on the output of at least one of the object detector 70 and the image capturing device 80.

Furthermore, the controller 30 may create a virtual line segment connecting the point Pa and the dumping start point Ps1 as an approach trajectory TLa that is part of the target trajectory TL. The point Pa represents the teeth tips position of the bucket 6 at the end of the boom raising and swing operation.

Furthermore, the controller 30 may create a virtual line segment connecting the dumping end point Pe1 and the point Pf as a withdrawing trajectory TLw that is another part of the target trajectory TL. The point Pf represents the teeth tips position of the bucket 6 at the start of the boom lowering and swing operation.

Furthermore, the controller 30 may also be configured to set the end position of the boom raising and swing operation, the target trajectory TL for the dumping operation, etc., between the left side gate LSG and the right side gate RSG. Furthermore, when the control reference point is set at the center of the bucket 6 in its lateral direction, the controller 30 may be configured to set the target trajectory TL for the dumping operation in the middle of the distance between the left side gate LSG and the right side gate RSG.

According to the above-described configuration, the controller 30 can assist the operator with the dumping operation. Therefore, the operator of the shovel 100, even when less skilled in the dumping operation, can perform the dumping operation the same as a skilled operator. Accordingly, the controller 30 can increase the work efficiency of the shovel 100. Furthermore, for example, the controller 30 can prevent the occurrence of such a situation where an excavation object is dumped onto the bed BD of the dump truck DT from a high position by an unskilled operator to spill out of the bed BD.

Figure 8A:
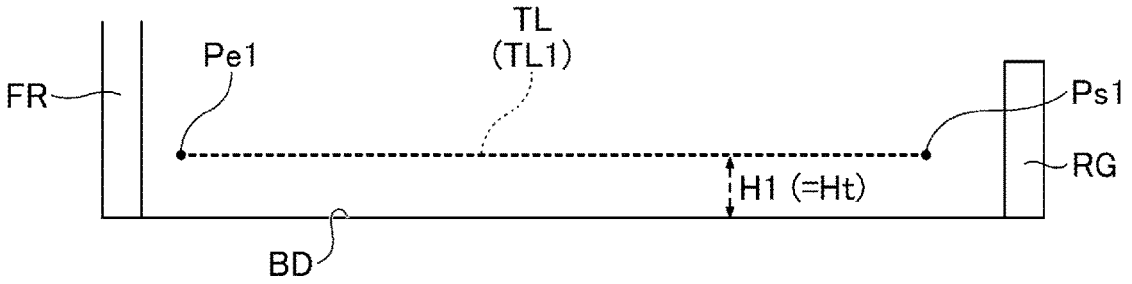
FIG. 8A is a side view of a bed of a dump truck when a dumping operation is performed.
Figure 8B:
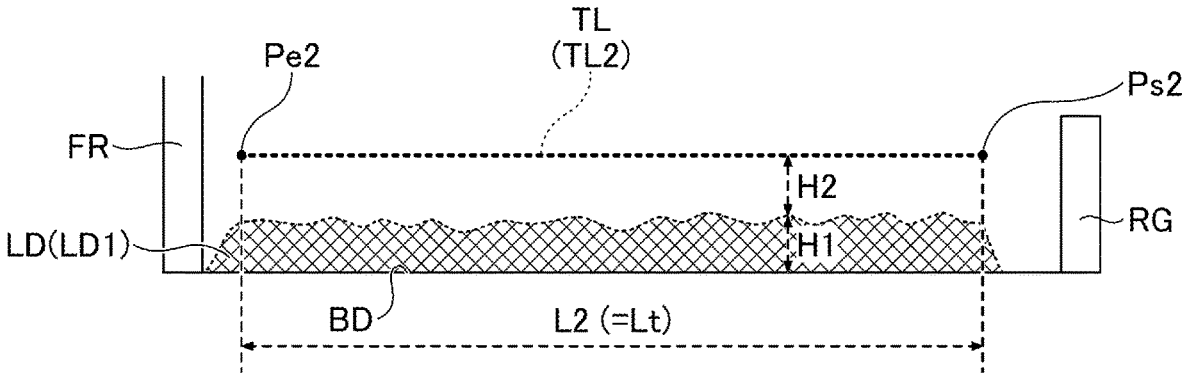
FIG. 8B is a side view of the bed of the dump truck when the dumping operation is performed.
Figure 8C:
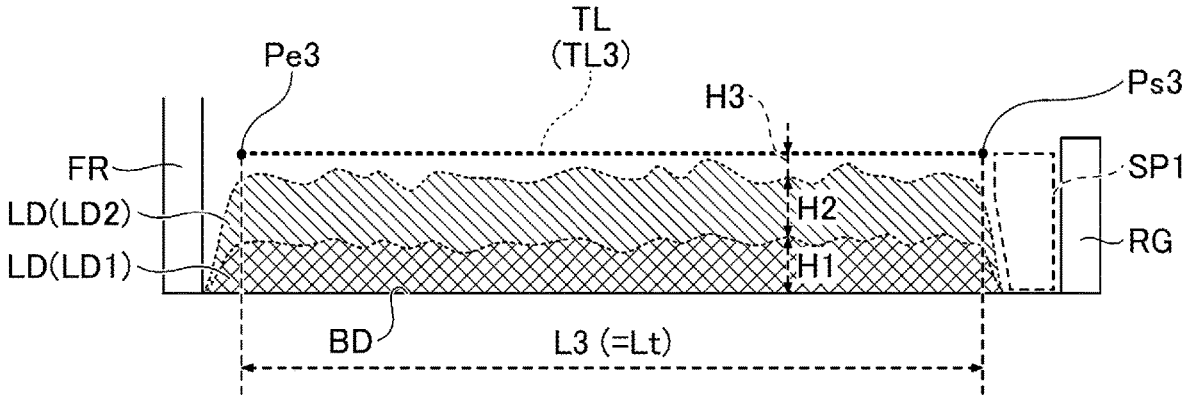
FIG. 8C is a side view of the bed of the dump truck when the dumping operation is performed.
Figure 8D:
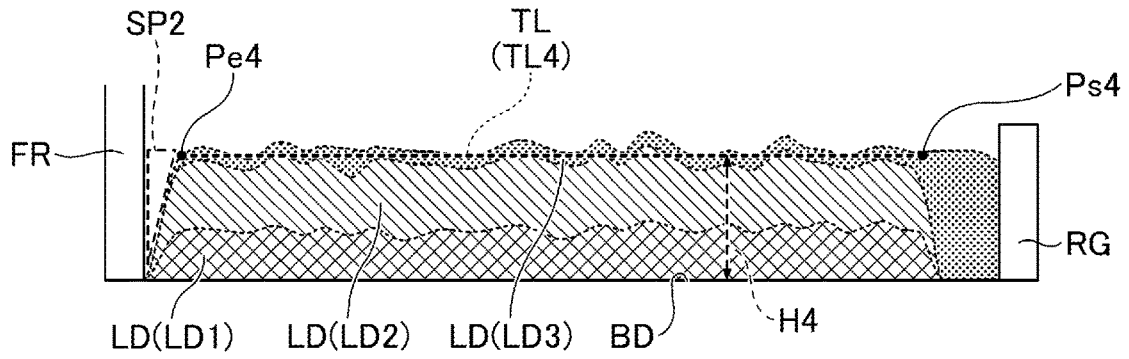
FIG. 8D is a side view of the bed of the dump truck when the dumping operation is performed.
Figure 8E:
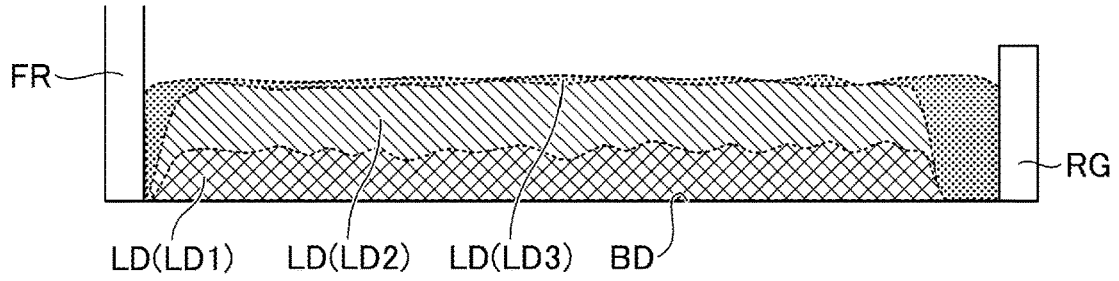
FIG. 8E is a side view of the bed of the dump truck when the dumping operation is performed.

Next, another example of the autonomous control with respect to a dumping operation is described with reference to FIGS. 8A through 8E. FIGS. 8A through 8E are side views of the bed BD of the dump truck DT when a dumping operation is performed. Specifically, FIG. 8A is a side view of the bed BD immediately before a dumping operation is performed. FIG. 8B is a side view of the bed BD immediately after the performance of the first dumping operation. FIG. 8C is a side view of the bed BD immediately after the performance of the second dumping operation. FIG. 8D is a side view of the bed BD immediately after the performance of the third dumping operation. FIG. 8E is a side view of the bed BD immediately after the performance of the fourth dumping operation.

In FIGS. 8A through 8E, the front panel FR and the rear gate RG of the dump truck DT are illustrated, while a depiction of the left side gate and the right side gate is omitted for clarification. Furthermore, in FIGS. 8A through 8E, a depiction of the entire image of the dump truck DT is omitted the same as in FIGS. 7B and 7C.

FIG. 8A illustrates the bed BD of the dump truck DT where no excavation object such as earth is loaded at all. The target trajectory TL1 for the first dumping operation illustrated in FIG. 8A is an example of the target trajectory TL, and is expressed as a virtual line segment connecting the dumping start point Ps1 and the dumping end point Pe1 at the height H1 from the bottom surface of the bed BD.

The height H1 is an example of the height Ht, and is calculated based on the volume of the excavation object scooped into the bucket 6 immediately before the performance of the first dumping operation, for example. Specifically, the height H1 is calculated such that the volume of a cuboid expressed as the product of the length Lt (L1), the height Ht (H1), and the width Wt is equal to the volume of the excavation object scooped into the bucket 6 immediately before the performance of the first dumping operation. The width Wt is a value corresponding to the width of the bucket 6, and is prestored in the nonvolatile storage, for example.

The controller 30 causes the excavation attachment AT to autonomously operate such that the teeth tips of the bucket 6 serving as the control reference point move along the target trajectory TL1. Furthermore, the controller 30 executes the bucket opening control in accordance with the movement of the teeth tips of the bucket 6 along the target trajectory TL1.

FIG. 8B illustrates the state of the bed BD immediately after the performance of the first dumping operation. Specifically, in FIG. 8B, the shape of the load LD1 formed by the first dumping operation is indicated by a cross pattern.

The target trajectory TL2 for the second dumping operation is an example of the target trajectory TL, and is expressed as a virtual line segment connecting the dumping start point Ps2 and the dumping end point Pe2 at the height H2 from the upper surface of the load LD1.

The height H2 is an example of the height Ht, and is calculated based on the volume of the excavation object scooped into the bucket 6 immediately before the performance of the second dumping operation, for example. Specifically, the height H2 is calculated such that the volume of a cuboid expressed as the product of the length Lt (L2), the height Ht (H2), and the width Wt is equal to the volume of the excavation object scooped into the bucket 6 immediately before the performance of the second dumping operation.

The controller 30 causes the excavation attachment AT to autonomously operate such that the teeth tips of the bucket 6 move along the target trajectory TL2 thus calculated. Furthermore, the controller 30 executes the bucket opening control in accordance with the movement of the teeth tips of the bucket 6 along the target trajectory TL2.

FIG. 8C illustrates the state of the bed BD immediately after the performance of the second dumping operation. Specifically, in FIG. 8C, the shape of the load LD2 formed by the second dumping operation is indicated by a pattern of downward diagonal lines.

A target trajectory TL3 for the third dumping operation is an example of the target trajectory TL, and is expressed as a virtual line segment connecting a dumping start point Ps3 and a dumping end point Pe3 at a height H3 from the upper surface of the load LD2.

The height H3 is an example of the height Ht, and is calculated based on the volume of the excavation object scooped into the bucket 6 immediately before the performance of the third dumping operation, for example. Specifically, the height H3 is calculated such that the total of the volume of a cuboid expressed as the product of the length Lt (L3), the height Ht (H3), and the width Wt and the volume of a space SP1 is equal to the volume of the excavation object scooped into the bucket 6 immediately before the performance of the third dumping operation.

The space SP1 is a space that can accommodate the excavation object between the load LD already loaded onto the bed BD and the rear gate RG. The volume of the space SP1 is derived based on the output of at least one of the object detector 70 and the image capturing device 80, for example. The volume of the space SP1 may be a value prestored in the nonvolatile storage.

The controller 30 causes the excavation attachment AT to autonomously operate such that the teeth tips of the bucket 6 move along the target trajectory TL3 thus calculated. Furthermore, the controller 30 executes the bucket opening control in accordance with the movement of the teeth tips of the bucket 6 along the target trajectory TL3.

Furthermore, when the teeth tips of the bucket 6 reach the dumping start point Ps3, the controller 30 executes bucket shaking control before moving the teeth tips of the bucket 6 along the target trajectory TL3.

The bucket shaking control is a control to fill the space SP1 with the excavation object by dropping part of the excavation object scooped into the bucket 6 into the space SP1.

Specifically, the controller 30 causes part of the excavation object lifted by the bucket 6 to fall out of the bucket 6 by slightly opening and closing the bucket 6 one or more times, namely, by slightly extending and retracting the bucket cylinder 9 one or more times.

The controller 30 may also cause part of the excavation object lifted by the bucket 6 to fall out of the bucket 6 by shaking the bucket 6 by moving at least one of the boom 4, the arm 5, and the bucket 6 one or more times.

According to this embodiment, the controller 30 starts moving the teeth tips of the bucket 6 along the target trajectory TL3 upon having shaken the bucket 6 a predetermined number of times, irrespective of whether the space SP1 is filled with part of the excavation object lifted by the bucket 6. The controller 30, however, may continue shaking the bucket 6 until determining that the space SP1 is filled with part of the excavation object. In this case, the controller 30 may determine whether the space SP1 is filled with part of the excavation object based on the output of at least one of the object detector 70 and the image capturing device 80.

FIG. 8D illustrates the state of the bed BD immediately after the performance of the third dumping operation. Specifically, in FIG. 8D, the shape of a load LD3 formed by the third dumping operation is indicated by a dot pattern.

A target trajectory TL4 for the fourth dumping operation is an example of the target trajectory TL, and is expressed as a virtual line segment connecting a dumping start point Ps4 and a dumping end point Pe4 at a height H4, which is slightly lower than the upper surface of the load LD3. The height H4 is a height from the bottom surface of the bed BD.

The height H4 is an example of the height Ht, and is calculated based on the height of the upper surface of the load LD3, for example. The fourth dumping operation is performed in order to level the upper surface of the load LD already loaded onto the bed BD with the back surface of the bucket 6 and push part of the excavation object at the top of the load LD with the back surface of the bucket 6 to drop the part of the excavation object into a space SP2 and fill in the space SP2. Therefore, the fourth dumping operation is performed with the empty bucket 6, namely, with no excavation object scooped into the bucket 6.

The space SP2 is a space that can accommodate the excavation object between the load LD already loaded onto the bed BD and the front panel FR.

Specifically, the height H4 is set to a height a predetermined distance lower than the upper surface of the load LD3. The controller 30 causes the excavation attachment AT to autonomously operate such that the teeth tips of the bucket 6 move along the target trajectory TL4.

FIG. 8E illustrates the state of the bed BD immediately after the performance of the fourth dumping operation. Specifically, FIG. 8E illustrates the shape of the load LD with the upper surface leveled by the fourth dumping operation and the space SP2 being filled with the excavation object. In the leveling operation, the control reference point may be switched from the teeth tips of the bucket 6 to a predetermined point on the back surface of the bucket 6.

According to the above-described configuration, the controller 30 can assist the operator with the dumping operation. Therefore, the operator of the shovel 100, even when less skilled in the dumping operation, can perform the dumping operation the same as a skilled operator. Accordingly, the controller 30 can increase the work efficiency of the shovel 100.

Figure 9A:
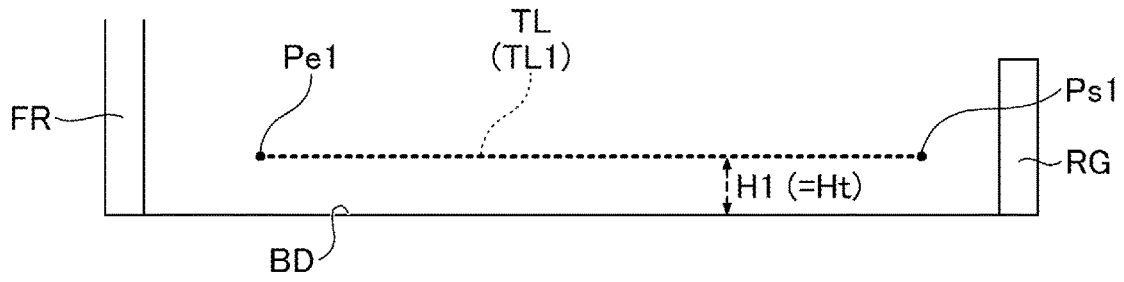
FIG. 9A is a side view of a bed of a dump truck when a dumping operation is performed.
Figure 9B:
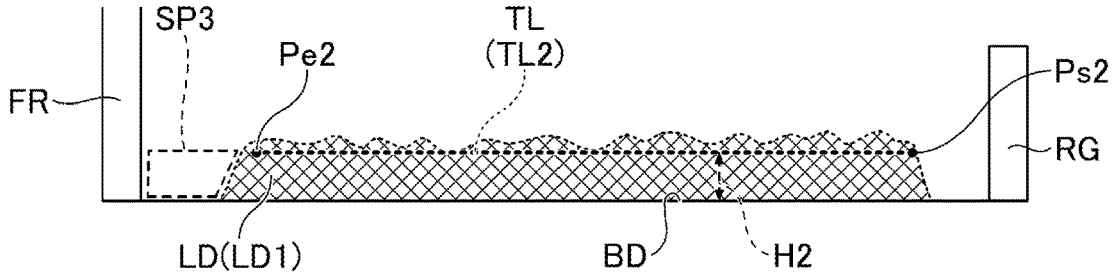
FIG. 9B is a side view of the bed of the dump truck when the dumping operation is performed.
Figure 9C:
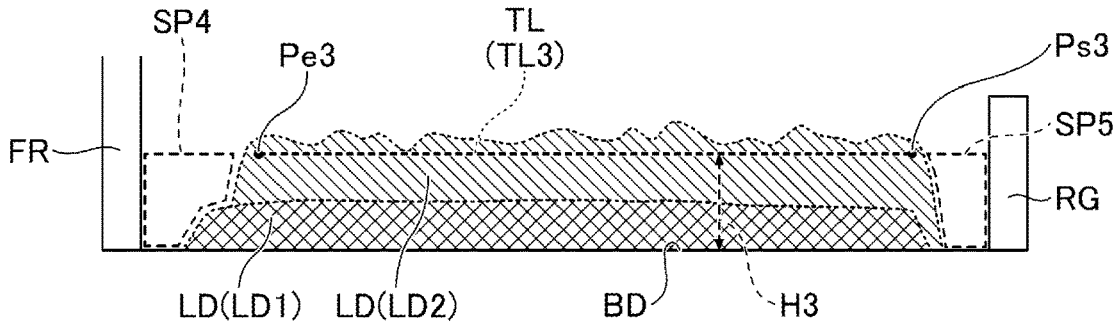
FIG. 9C is a side view of the bed of the dump truck when the dumping operation is performed.
Figure 9D:
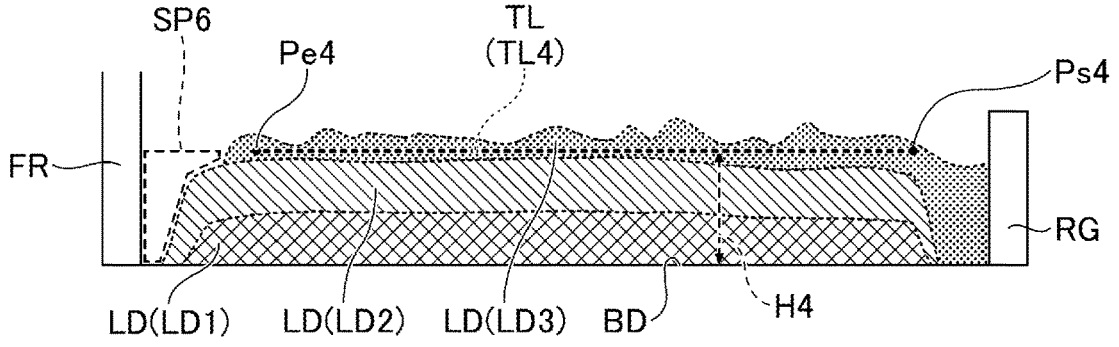
FIG. 9D is a side view of the bed of the dump truck when the dumping operation is performed.
Figure 9E:
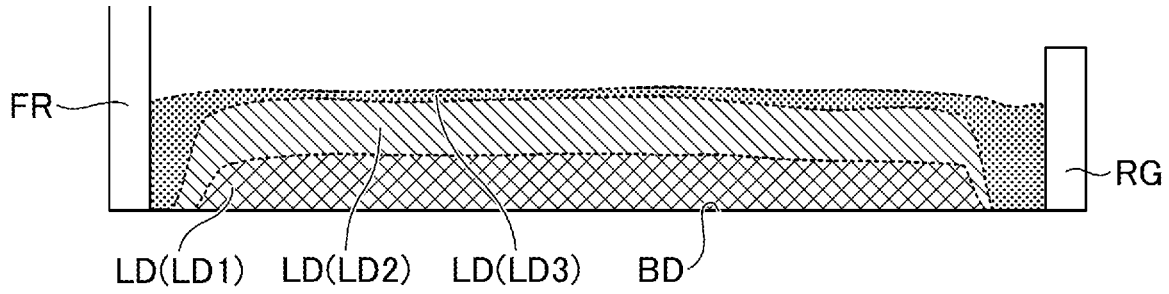
FIG. 9E is a side view of the bed of the dump truck when the dumping operation is performed.

Next, yet another example of the autonomous control with respect to a dumping operation is described with reference to FIGS. 9A through 9E. FIGS. 9A through 9E are side views of the bed BD of the dump truck DT when a dumping operation is performed. Specifically, FIG. 9A is a side view of the bed BD immediately before a dumping operation is performed. FIG. 9B is a side view of the bed BD immediately after the performance of the first dumping operation. FIG. 9C is a side view of the bed BD immediately after the performance of the second dumping operation. FIG. 9D is a side view of the bed BD immediately after the performance of the third dumping operation. FIG. 9E is a side view of the bed BD immediately after the performance of the fourth dumping operation.

In FIGS. 9A through 9E, the front panel FR and the rear gate RG of the dump truck DT are illustrated, while a depiction of the left side gate and the right side gate is omitted for clarification. Furthermore, in FIGS. 9A through 9E, a depiction of the entire image of the dump truck DT is omitted the same as in FIGS. 7B, 7C and 8A through 8E.

FIG. 9A illustrates the bed BD of the dump truck DT where no excavation object such as earth is loaded at all. The target trajectory TL1 for the first dumping operation illustrated in FIG. 9A is an example of the target trajectory TL, and is expressed as a virtual line segment connecting the dumping start point Ps1 and the dumping end point Pe1 at the height H1 from the bottom surface of the bed BD.

The height H1 is an example of the height Ht, and is calculated based on the volume of the excavation object scooped into the bucket 6 immediately before the performance of the first dumping operation, for example. Specifically, the height H1 is calculated such that the volume of a cuboid expressed as the product of the length Lt (L1), the height Ht (H1), and the width Wt is equal to the volume of the excavation object scooped into the bucket 6 immediately before the performance of the first dumping operation. The width Wt is a value corresponding to the width of the bucket 6, and is prestored in the nonvolatile storage, for example.

The controller 30 causes the excavation attachment AT to autonomously operate such that the teeth tips of the bucket 6 serving as the control reference point move along the target trajectory TL1. Furthermore, the controller 30 executes the bucket opening control in accordance with the movement of the teeth tips of the bucket 6 along the target trajectory TL1.

FIG. 9B illustrates the state of the bed BD immediately after the performance of the first dumping operation. Specifically, in FIG. 9B, the shape of the load LD1 formed by the first dumping operation is indicated by a cross pattern.

The target trajectory TL2 for the second dumping operation is an example of the target trajectory TL, and is expressed as a virtual line segment connecting the dumping start point Ps2 and the dumping end point Pe2 at the height H2, which is slightly lower than the upper surface of the load LD1. The height H2 is a height from the bottom surface of the bed BD.

The height H2 is an example of the height Ht, and is calculated based on the height of the upper surface of the load LD1, for example. The second dumping operation is performed in order to load the bed BD with the excavation object scooped into the bucket 6, level the upper surface of the load LD1 already loaded onto the bed BD with the back surface of the bucket 6, and push part of the excavation object at the top of the load LD with the back surface of the bucket 6 to drop the part of the excavation object into a space SP3 and fill in the space SP3.

The space SP3 is a space that can accommodate the excavation object between the load LD1 already loaded onto the bed BD and the front panel FR.

Specifically, the height H2 is set to a height a predetermined distance lower than the upper surface of the load LD1. The controller 30 causes the excavation attachment AT to autonomously operate such that the teeth tips of the bucket 6 move along the target trajectory TL2. That is, while breaking the top of the load LD1 formed by the first dumping operation that is the previous dumping operation, the controller 30 forms the new layer of the load LD2 with the excavation object newly loaded by the second dumping operation that is the dumping operation of this time. Furthermore, the controller 30 executes the bucket opening control in accordance with the movement of the teeth tips of the bucket 6 along the target trajectory TL2. In the bucket opening control, the controller 30 changes the bucket angle $\beta_3$ such that the height of the load newly formed by the excavation object scooped into the bucket 6 becomes a desired height. The desired height is typically determined based on the length of the target trajectory TL2 and the volume of the excavation object scooped into the bucket 6.

FIG. 9C illustrates the state of the bed BD immediately after the performance of the second dumping operation. Specifically, in FIG. 9C, the shape of the load LD2 formed by the second dumping operation is indicated by a pattern of downward diagonal lines.

The target trajectory TL3 for the third dumping operation is an example of the target trajectory TL, and is expressed as a virtual line segment connecting the dumping start point Ps3 and the dumping end point Pe3 at the height H3, which is slightly lower than the upper surface of the load LD2. The height H3 is a height from the bottom surface of the bed BD.

The height H3 is an example of the height Ht, and is calculated based on the height of the upper surface of the load LD2, for example. The third dumping operation is performed in order to load the bed BD with the excavation object scooped into the bucket 6, level the upper surface of the load LD2 already loaded onto the bed BD with the back surface of the bucket 6, and push part of the excavation object at the top of the load LD2 with the back surface of the bucket 6 to drop the part of the excavation object into a space SP4 and fill in the space SP4.

The space SP4 is a space that can accommodate the excavation object between the load LD already loaded onto the bed BD and the front panel FR.

Specifically, the height H3 is set to a height a predetermined distance lower than the upper surface of the load LD2. The controller 30 causes the excavation attachment AT to autonomously operate such that the teeth tips of the bucket 6 move along the target trajectory TL3.

The controller 30 causes the excavation attachment AT to autonomously operate such that the teeth tips of the bucket 6 move along the target trajectory TL3 thus calculated. Furthermore, the controller 30 executes the bucket opening control in accordance with the movement of the teeth tips of the bucket 6 along the target trajectory TL3.

Furthermore, when the teeth tips of the bucket 6 reach the dumping start point Ps3, the controller 30 executes the bucket shaking control before moving the teeth tips of the bucket 6 along the target trajectory TL3.

The bucket shaking control is a control to fill a space SP5 with the excavation object by dropping part of the excavation object scooped into the bucket 6 into the space SP5.

The space SP5 is a space that can accommodate the excavation object between the load LD already loaded onto the bed BD and the rear gate RG.

Specifically, the controller 30 causes part of the excavation object lifted by the bucket 6 to fall out of the bucket 6 by slightly opening and closing the bucket 6 one or more times, namely, by slightly extending and retracting the bucket cylinder 9 one or more times.

The controller 30 may also cause part of the excavation object lifted by the bucket 6 to fall out of the bucket 6 by shaking the bucket 6 by moving at least one of the boom 4, the arm 5, and the bucket 6 one or more times.

According to this embodiment, the controller 30 starts moving the teeth tips of the bucket 6 along the target trajectory TL3 upon having shaken the bucket 6 a predetermined number of times, irrespective of whether the space SP5 is filled with part of the excavation object scooped into the bucket 6. The controller 30, however, may continue shaking the bucket 6 until determining that the space SP5 is filled with part of the excavation object. In this case, the controller 30 may determine whether the space SP5 is filled with part of the excavation object based on the output of at least one of the object detector 70 and the image capturing device 80.

FIG. 9D illustrates the state of the bed BD immediately after the performance of the third dumping operation. Specifically, in FIG. 9D, the shape of the load LD3 formed by the third dumping operation is indicated by a dot pattern.

The target trajectory TL4 for the fourth dumping operation is an example of the target trajectory TL, and is expressed as a virtual line segment connecting the dumping start point Ps4 and the dumping end point Pe4 at the height H4, which is slightly lower than the upper surface of the load LD3. The height H4 is a height from the bottom surface of the bed BD.

The height H4 is an example of the height Ht, and is calculated based on the height of the upper surface of the load LD3, for example. The fourth dumping operation is performed in order to level the upper surface of the load LD3 already loaded onto the bed BD with the back surface of the bucket 6 and push part of the excavation object at the top of the load LD3 with the back surface of the bucket 6 to drop the part of the excavation object into a space SP6 and fill in the space SP6. Therefore, the fourth dumping operation is performed with the empty bucket 6, namely, with no excavation object scooped into the bucket 6.

The space SP6 is a space that can accommodate the excavation object between the load LD already loaded onto the bed BD and the front panel FR.

Specifically, the height H4 is set to a height a predetermined distance lower than the upper surface of the load LD3. The controller 30 causes the excavation attachment AT to autonomously operate such that the teeth tips of the bucket 6 move along the target trajectory TL4.

FIG. 9E illustrates the state of the bed BD immediately after the performance of the fourth dumping operation. Specifically, FIG. 9E illustrates the shape of the load LD with the upper surface leveled by the fourth dumping operation and the space SP6 being filled with the excavation object. In the leveling operation, the control reference point may be switched from the teeth tips of the bucket 6 to a predetermined point on the back surface of the bucket 6.

According to the above-described configuration, the controller 30 can assist the operator with the dumping operation. Therefore, the operator of the shovel 100, even when less skilled in the dumping operation, can perform the dumping operation the same as a skilled operator. Accordingly, the controller 30 can increase the work efficiency of the shovel 100.

As described above, the shovel 100 according to an embodiment of the present invention includes the lower traveling structure 1, the upper swing structure 3 swingably mounted on the lower traveling structure 1, and the controller 30 serving as a control device provided on the upper swing structure 3. The controller 30 is configured to recognize the position of the dump truck DT and create the target trajectory TL for a dumping operation. According to this configuration, the shovel 100 can autonomously perform the dumping operation.

The target trajectory TL is desirably set along the longitudinal direction of the dump truck DT. Furthermore, the target trajectory TL is set at a predetermined height along the bottom surface of the bed BD of the dump truck DT. According to this configuration, the controller 30 can efficiently dump the excavation object scooped into the bucket 6 onto the bed BD of the dump truck DT.

The controller 30 is desirably configured to set the bucket angle $\beta_3$ for each point on the target trajectory TL. According to this configuration, the controller 30 can even out the height of the load LD loaded onto the bed BD of the dump truck DT.

The controller 30 may also be configured to control the bucket angle $\beta_3$ based on the shape of the load LD loaded onto the bed BD of the dump truck DT. According to this configuration, the controller 30 can further even out the height of the load LD loaded onto the bed BD of the dump truck DT.

The controller 30 is desirably configured to detect the distance between the back surface of the bucket 6 and the dump truck DT. According to this configuration, the controller 30 can prevent contact between the bucket 6 and the dump truck DT during execution of the autonomous control with respect to a dumping operation.

Figure 13:
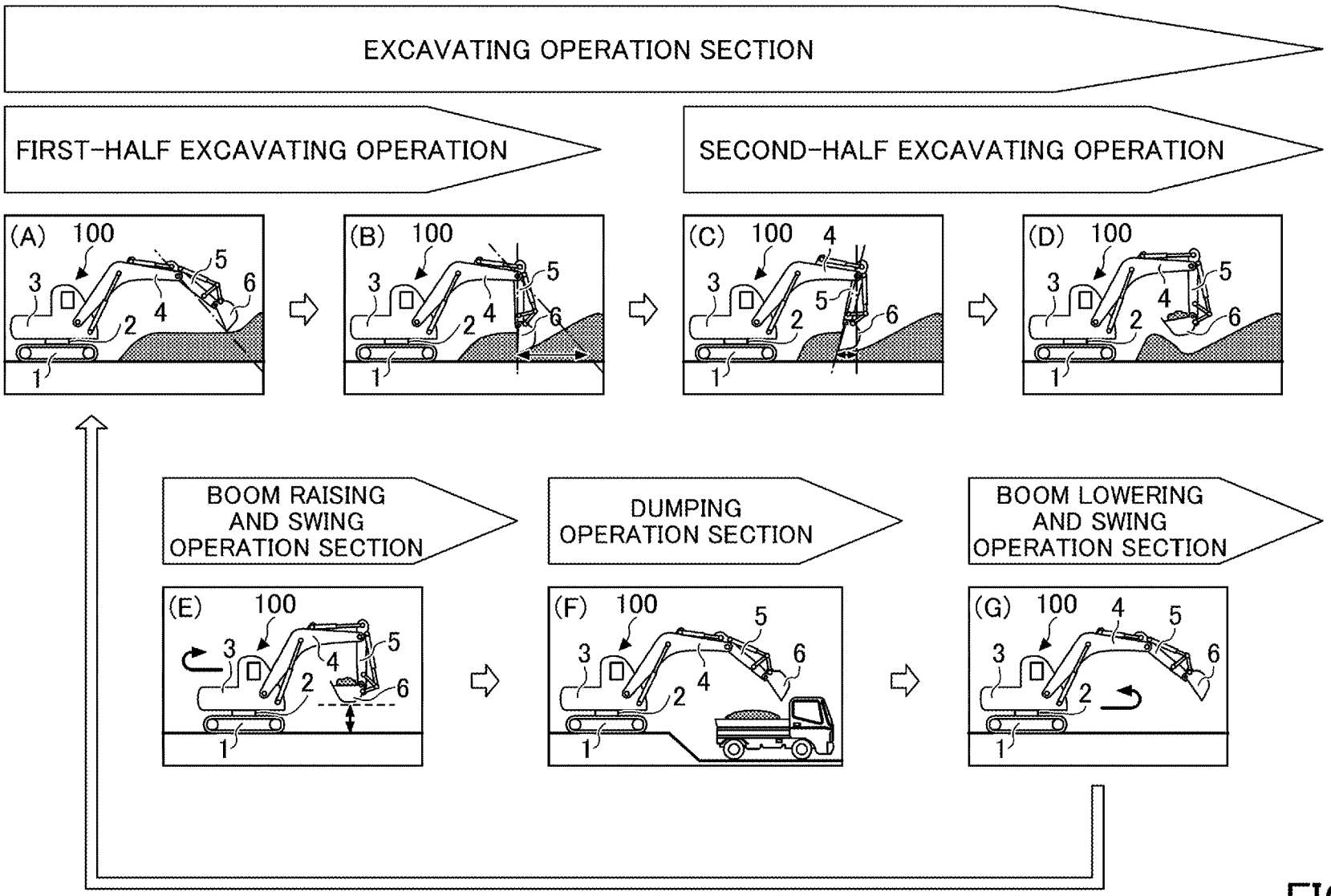
FIG. 13 is an explanatory diagram explaining a workflow of an "excavating and loading operation" of the shovel.

Here, the workflow of the "excavating and loading operation" of the shovel 100 is described using FIG. 13. FIG. 13 is an explanatory diagram explaining a workflow of the "excavating and loading operation" of the shovel 100.

In FIG. 13, (A) through (D) illustrate a state where an excavating operation is being performed. A section where an excavating operation is performed is referred to as an excavating operation section. Furthermore, the excavating operation is divided into a first-half excavating operation of (A) and (B) of FIG. 13 and a second-half excavating operation of (C) and (D) of FIG. 13.

The controller 30 positions the leading edge of the bucket 6 such that the leading edge of the bucket 6 is at a desired height position relative to an excavation target (earth in this example) as illustrated in (A) of FIG. 13, and closes the arm 5 that is open as illustrated in (A) of FIG. 13 until the arm 5 is substantially perpendicular to the ground as illustrated in (B) of FIG. 13. As a result of this operation, earth is excavated to a certain depth, and is scraped before the arm 5 becomes substantially perpendicular to the ground surface. The above-described operation is referred to as the first-half excavating operation, and this section of operation is referred to as a first-half excavating operation section.

Thereafter, as illustrated in (C) of FIG. 13, the controller 30 further closes the arm 5 to scrape the earth with the bucket 6. Then, as illustrated in (D) of FIG. 13, the controller 30 closes the bucket 6 until its upper edge becomes substantially horizontal to accommodate the scraped and collected earth in the bucket 6. Furthermore, the controller 30 raises the boom 4 to elevate the bucket 6 to the position illustrated in (D) of FIG. 13. The above-described operation is referred to as the second-half excavating operation, and this section of operation is referred to as a second-half excavating operation section. The operation of (C) of FIG. 13 may be the complex operation of the arm 5 and the bucket 6.

Next, the controller 30 raises the boom 4 until the bottom of the bucket 6 is at a desired height from the ground as illustrated in (E) of FIG. 13, with the upper edge of the bucket 6 being substantially horizontal. The desired height is, for example, a height more than the height of the rear gate RG of the dump truck DT. Subsequent to or at the same time with this operation, the controller 30 swings the upper swing structure 3 as indicated by the arrow to move the bucket 6 to a dumping position.

Thereafter, completing the boom raising and swing operation, the controller 30 next opens the arm 5 and the bucket 6 to discharge the earth in the bucket 6 onto the bed BD of the dump truck DT as illustrated in (F) of FIG. 13. In this earth discharging operation (dumping operation), the controller 30 may open only the bucket 6 to discharge the earth.

Completing the dumping operation, the controller 30 next swings the upper swing structure 3 as indicated by the arrow to move the bucket 6 to a position directly above an excavation position as illustrated in (G) of FIG. 13. At this point, the controller 30 lowers the boom 4 at the same time with the swinging to lower the bucket 6 to a desired height from an excavation target. Thereafter, the controller 30 lowers the bucket 6 to a desired height as illustrated in (A) of FIG. 13 to perform another excavating operation.

The target trajectory TL may be set according to work progress with respect to each of the excavating operation section, the boom raising and swing operation section, the dumping operation section, and the boom lowering and swing operation section. For example, the controller 30 may set the target trajectory TL in the excavating operation section and the target trajectory TL in the dumping operation section, and may calculate the target trajectory TL in the boom raising and swing operation section in such a manner as to connect the start point of the dumping operation section and the end point of the excavating operation section and calculate the target trajectory TL in the boom lowering and swing operation section in such a manner as to connect the start point of the excavating operation section and the end point of the dumping operation section.

The target trajectory TL in the dumping operation section is set between the dumping start point Ps1 and the dumping end point Pe1 based on the position of the bed BD of the dump truck DT recognized as described above. The target trajectory TL in the dumping operation section is updated each time the dumping operation is performed as described above.

The target trajectory TL in the excavating operation section is set between an excavation start position and an excavation end position. The target trajectory TL in the excavating operation section is set based on the shape of earth (such as a terrain shape, the shape of a bank of earth, or the shape of a provisional mound of earth) each time the excavating operation is performed. The controller 30 may calculate the shape of earth based on the trajectory of the leading edge of the bucket 6 or may calculate the shape of earth based on the detection value of a device that can detect the surface shape of earth, such as the object detector 70 or the image capturing device 80. Thus, the target trajectory TL in the excavating operation section is updated according as the shape of earth is updated each time the excavating operation is performed. Furthermore, the controller 30 may set a design surface used in finishing excavation as the target trajectory TL in the excavating operation section. The object detector 70, the image capturing device 80 or the like used for obtaining the shape of earth may be installed independent of the shovel 100. Specifically, the object detector 70, the image capturing device 80 or the like may be attached to a multicopter for aerial photography or a steel tower installed in a worksite. The controller 30 may obtain information on the shape of earth of a worksite based on an image showing an aerial view of the worksite. Furthermore, the target trajectory TL in the excavating operation section may be calculated, taking the shape of the bucket 6, earth properties, etc., into account. Furthermore, the target trajectory TL in the excavating operation section may be calculated using reinforcement learning (machine learning) based on the shape of earth before excavation and an intended construction surface (design surface). In the case of using reinforcement learning, the amount of fuel consumption, working hours, or the like may be set as a reward.

The target trajectory TL in the boom lowering and swing section is set between the dumping end point Pe1 or a boom lowering and swing start position set above the bed BD of the dump truck DT (for example, the point Pf in FIG. 7A) and the excavation start position. Here, the target trajectory TL in the boom lowering and swing section may include the withdrawing trajectory TLw when set between the dumping end point Pe1 and the excavation start position.

The target trajectory TL in the boom raising and swing section is set between the dumping start point Ps1 or a boom raising and swing end position set above the bed BD (for example, the point Pa in FIG. 7A) and the excavation end position. Here, the target trajectory TL in the boom raising and swing section may include the approach trajectory TLa when set between the excavation end position and the dumping start point Ps1.

Thus, the controller 30 advances the "excavating and loading operation", repeating a cycle constituted of the "first-half excavating operation," the "second-half excavating operation," the "boom raising and swing operation", the "dumping operation," and the "boom lowering and swing operation."

An embodiment of the present invention is described above. The present invention, however, is not limited to the above-described embodiment. Various variations, substitutions, etc., may be applied to the above-described embodiment without departing from the scope of the present invention. Furthermore, separately described features may be combined to the extent that no technical contradiction is caused.

Figure 10:
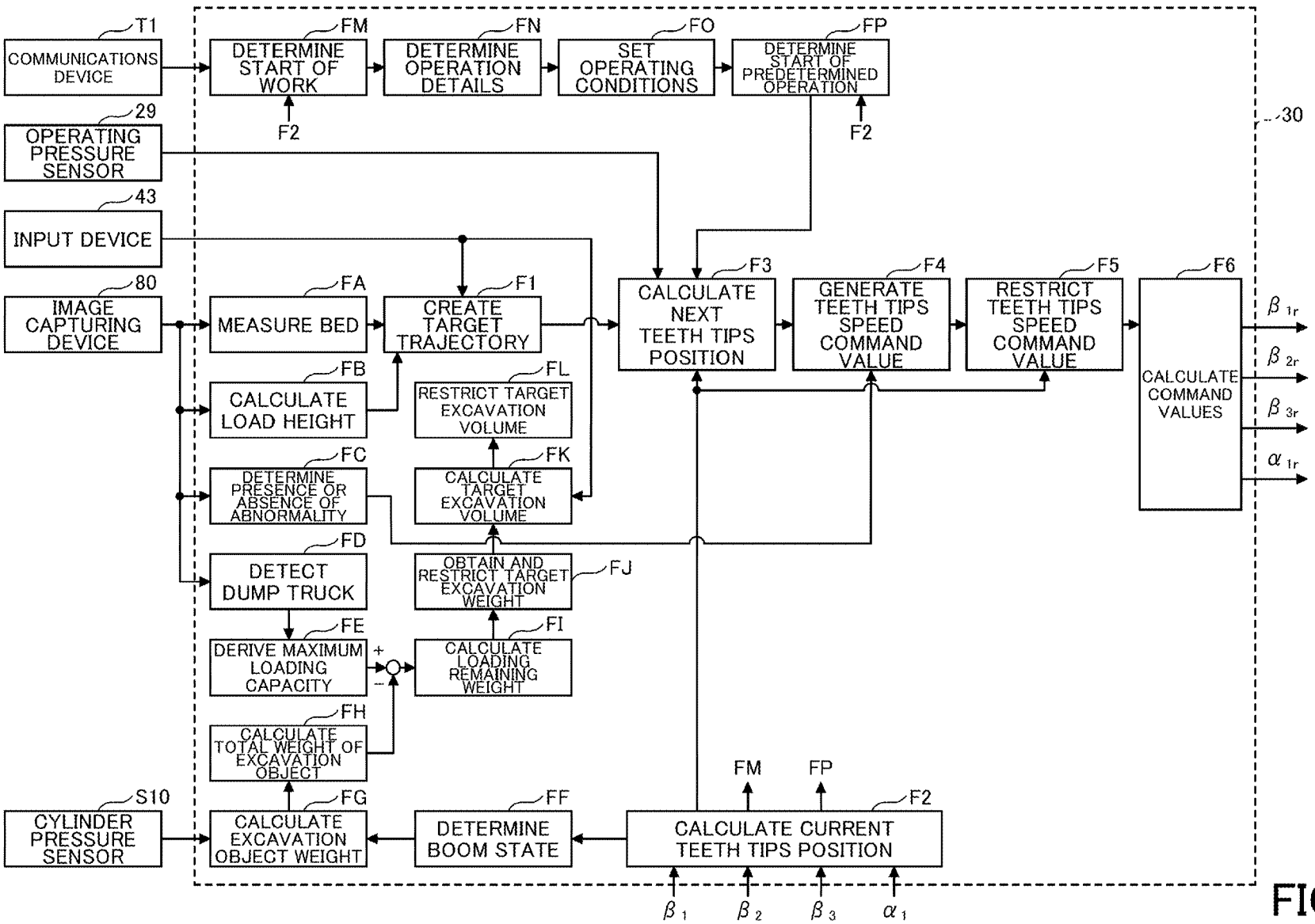
FIG. 10 is a block diagram illustrating another example configuration of the autonomous control function.

For example, the shovel 100 may autonomously execute a complex operation of a dumping operation, etc., by executing an autonomous control function as illustrated below. FIG. 10 is a block diagram illustrating an example configuration of the autonomous control function. According to the example of FIG. 10, the controller 30 includes functional blocks FA through FP and F1 through F6 related to the execution of autonomous control. The functional blocks may be constituted of software, may be constituted of hardware, or may be constituted of a combination of software and hardware.

The functional block FA is configured to measure the bed BD of the dump truck DT. According to the example of FIG. 10, the functional block FA measures the bed BD of the dump truck DT based on an image captured by the image capturing device 80 serving as a surroundings monitoring device. The surrounding monitoring device may be the object detector 70.

The functional block FB is configured to calculate the height of a load. According to the example of FIG. 10, the functional block FB calculates the height of a load formed by an excavation object scooped into the bucket 6 when the excavation object is dumped onto the bed BD of the dump truck DT, based on an image captured by the image capturing device 80.

The functional block FC is configured to determine the presence or absence of various abnormalities. According to the example of FIG. 10, the functional block FC is configured to determine the presence or absence of an abnormality in the image capturing device 80 based on an image captured by the image capturing device 80. In response to determining that the state of the image capturing device 80 is abnormal, the functional block FC outputs a command to the below-described functional block F4 to decelerate or stop the movement of the shovel 100.

The functional block FD is configured to detect the dump truck DT. According to the example of FIG. 10, the functional block FD detects the dump truck DT based on an image captured by the image capturing device 80.

The functional block FE is configured to derive the maximum loading capacity of the dump truck DT detected by the functional block FD. According to the example of FIG. 10, the functional block FE derives the maximum loading capacity of the dump truck DT based on an image captured by the image capturing device 80. For example, the functional block FE derives the maximum loading capacity of the dump truck DT by identifying whether the dump truck DT is a 10-ton truck.

The functional block FF is configured to determine the state of the boom 4. According to the example of FIG. 10, the functional block FF determines whether the boom 4 has risen to a height where the bucket 6 into which an excavation object is scooped leaves the ground. This is for detecting the end of an excavating operation.

Specifically, the functional block FF determines whether the boom 4 has risen to a height where the bucket 6 into which an excavation object is scooped leaves the ground based on the current teeth tips position of the bucket 6 calculated by the below-described functional block F2. The functional block FF may also determine whether the boom 4 has risen to a height where the bucket 6 into which an excavation object is scooped leaves the ground based on an image captured by the image capturing device 80.

The functional block FG is configured to calculate the weight of the excavation object scooped into the bucket 6. According to the example of FIG. 10, the functional bock FG calculates the weight of the excavation object scooped into the bucket 6 based on the output of a cylinder pressure sensor S10 in response to the functional block FF determining that the boom 4 has risen to a height where the bucket 6 into which the excavation object is scooped leaves the ground. The cylinder pressure sensor S10 includes at least one of, for example, a boom bottom pressure sensor to detect a boom bottom pressure that is the pressure of hydraulic oil in the bottom-side oil chamber of the boom cylinder 7, a boom rod pressure sensor to detect a boom rod pressure that is the pressure of hydraulic oil in the rod-side oil chamber of the boom cylinder 7, an arm bottom pressure sensor to detect an arm bottom pressure that is the pressure of hydraulic oil in the bottom-side oil chamber of the arm cylinder 8, an arm rod pressure sensor to detect an arm rod pressure that is the pressure of hydraulic oil in the rod-side oil chamber of the arm cylinder 8, a bucket bottom pressure sensor to detect a bucket bottom pressure that is the pressure of hydraulic oil in the bottom-side oil chamber of the bucket cylinder 9, a bucket rod pressure sensor to detect a bucket rod pressure that is the pressure of hydraulic oil in the rod-side oil chamber of the bucket cylinder 9, etc. The functional block FG may calculate the weight of the excavation object scooped into the bucket 6 based on the pose of the excavation attachment AT calculated by the below-described functional block F2 and the output of the cylinder pressure sensor S10.

The functional block FH is configured to calculate the total weight of the excavation object loaded onto the dump truck DT. According to the example of FIG. 10, the functional block FH calculates the total weight of the excavation object already loaded onto the bed BD of the dump truck DT by integrating the weights of excavation objects excavated by excavating operations calculated by the functional block FG.

The functional block FI is configured to calculate a loading remaining weight. According to the example of FIG. 10, the functional block FI calculate the loading remaining weight by subtracting the total weight of the excavation object calculated by the functional block FH from the maximum loading capacity derived by the functional block FE. For example, when the maximum loading capacity is ten tons and the total weight of the excavation object already loaded onto the bed BD of the dump truck DT is six tons, the functional block FH calculates the loading remaining weight at four tons.

The functional block FJ is configured to obtain a target excavation weight that is the weight of an excavation object to be scooped into the bucket 6 by the next excavating operation and restrict the obtained value on an as-needed basis. According to the example of FIG. 10, the functional block FJ reads from the nonvolatile storage and obtains a maximum excavation weight that is the maximum value of an excavation object that can be excavated by a single excavation operation. If the loading remaining weight calculated by the functional block FI is greater than the maximum excavation weight, the functional block FJ restricts the target excavation weight to the maximum excavation weight. For example, even when the loading remaining weight is four tons, the functional block FJ outputs three tons as the target excavation weight if the maximum excavation weight is three tons. The maximum excavation weight may be a value that is dynamically input or calculated.

The functional block FK is configured to calculate a target excavation volume. According to the example of FIG. 10, the functional block FK calculates the target excavation volume based on the target excavation weight output by the functional block FJ and soil property information input via the input device 43. The input device 43 is configured in such a manner as to enable the operator to input various kinds of information to the controller 30. The input device 43 is, for example, at least one of a touchscreen, a microphone, a knob switch, a membrane switch, etc., installed in the cabin 10. The soil property information is, for example, information on the density, hardness or the like of the excavation object. The soil property information may be information prestored in the nonvolatile storage. The functional block FK calculates the target excavation volume based on the target excavation weight and the density of the excavation object, for example. The functional block FK, for example, calculates the target excavation volume corresponding to three tons that is the target excavation weight. Basically, even when the target excavation weight is constant (for example, three tons), the target excavation volume increases as the density of the excavation object decreases.

The functional block FL is configured to restrict the target excavation volume. According to the example of FIG. 10, when the target excavation volume calculated by the functional block FK is greater than a maximum excavation volume, the functional block FL restricts the target excavation volume to the maximum excavation volume. For example, even when the target excavation volume is three cubic meters, the functional block FL outputs two cubic meters as the target excavation volume if the maximum excavation volume is two cubic meters. Thus, the controller 30 restricts the target excavation volume on an as-needed basis in order to prevent the excavation object scooped into the bucket 6 from falling out during a subsequent swing operation or the like. The maximum excavation volume may be a value that is dynamically input or calculated.

The functional block F1 is configured to create a target trajectory. According to the example of FIG. 10, the functional block F1 creates, as the target trajectory, a trajectory to be followed by the teeth tips of the bucket 6 during a dumping operation, based on information on dumping input via the input device 43, the shape of the bed BD of the dump truck DT measured by the functional block FA, and the height of the load calculated by the functional block FB. The information on dumping is, for example, information on a preset dumping start point and dumping end point. The information on the dumping start point includes the distance between the dumping start point and the rear gate RG of the dump truck DT and the information on the dumping end point includes the distance between the dumping end point and the front panel FR of the dump truck DT.

The functional block F1 is typically configured to calculate the target trajectory before the start of the dumping operation of each time. That is, the target trajectory is typically updated before the start of the dumping operation of each time. Specifically, the coordinates of the dumping start point, which is the start point of the target trajectory, and the coordinates of the dumping end point, which is the end point of the target trajectory, are updated before the start of the dumping operation of each time.

The functional block F1 may also be configured to display an image regarding the created target trajectory on the display device D1.

The functional block F1 may display the image regarding the target trajectory on the display device D1 together with at least one of a back monitoring image and a surroundings monitoring image. The back monitoring image is an image for enabling the operator to monitor an area behind the shovel 100 and is generated based on an image captured by the back camera 80B, for example. The surroundings monitoring image is an image for enabling the operator to monitor an area surrounding the shovel 100 and is an overhead view image as a viewpoint change image generated by combining respective captured images of the back camera 80B, the left camera 80L, and the right camera 80R, for example. The overhead view image is typically an image showing a view of an area surrounding the shovel 100 as seen from a virtual viewpoint directly above. The functional block F1 may display the image regarding the target trajectory on the display device D1 such that the image regarding the target trajectory is next to at least one of the back monitoring image and the surroundings monitoring image, for example.

The functional block F1 may also display the image regarding the target trajectory on the display device D1 together with information on the settings of the shovel 100, which is information on at least one of an engine rotational speed mode, a traveling mode, an attachment type, an engine control status, etc. The functional block F1 may also display the image regarding the target trajectory on the display device D1 together with information on the operating condition of the shovel 100, which is information on at least one of the remaining amount of an aqueous urea solution, the remaining amount of fuel, coolant water temperature, an engine operating time, a cumulative operating time, etc.

The functional block F2 is configured to calculate a current teeth tips position. According to the example of FIG. 10, the functional block F2 calculates the coordinate point of the teeth tips of the bucket 6 as the current teeth tips position, based on the boom angle $\beta_1$ detected by the boom angle sensor S1, the arm angle $\beta_2$ detected by the arm angle sensor S2, the bucket angle $\beta_3$ detected by the bucket angle sensor S3, and the swing angle $\alpha_1$ detected by the swing angular velocity sensor S5. The functional block F2 may use the output of the machine body tilt sensor S4 in calculating the current teeth tips position.

The functional block F3 is configured to calculate the next teeth tips position. According to the example of FIG. 10, the functional block F3 calculates a teeth tips position after passage of a predetermined time as a target teeth tips position, based on operation data output by the operating pressure sensor 29, the target trajectory created by the functional block F1, and the current teeth tips position calculated by the functional block F2, in the case of a manually operated manned shovel. A process flow in a self-operating unmanned shovel is described below.

The functional block F3 may also determine whether the deviation between the current teeth tips position and the target trajectory is within an allowable range. According to the example of FIG. 10, the functional block F3 determines whether the distance between the current teeth tips position and the target trajectory is less than or equal to a predetermined value. If the distance is less than or equal to the predetermined value, the functional block F3 determines that the deviation is within the allowable range and calculates the target teeth tips position. If the distance exceeds the predetermined value, the functional block F3 determines that the deviation is not within the allowable range and decelerate or stops the movement of an actuator irrespective of the amount of lever operation.

The functional block F4 is configured to generate a command value for the speed of the teeth tips. According to the example of FIG. 10, the functional block F4 calculates the speed of the teeth tips necessary to move from the current teeth tips position to the next teeth tips position in a predetermined time as the command value for the speed of the teeth tips, based on the current teeth tips position calculated by the functional block F2 and the next teeth tips position calculated by the functional block F3.

The functional block F5 is configured to restrict the command value for the speed of the teeth tips. According to the example of FIG. 10, the functional block F5 restricts the command value for the speed of the teeth tips to a predetermined upper limit value in response to determining that the distance between the teeth tips and a predetermined object such as the dump truck DT is less than a predetermined value based on the current teeth tips position calculated by the functional block F2 and an image captured by the image capturing device 80 serving as a surroundings monitoring device. Thus, the controller 30 decreases the speed of the teeth tips when the teeth tips come close to the predetermined object. The functional block F5 may also be configured to change the upper limit value based on the weight of the excavated object scooped into the bucket 6. The functional block F5 may also be configured to change the upper limit value based on the swing radius of the excavation attachment AT. The swing radius of the excavation attachment AT may be calculated by the functional block F2 or may be calculated by the functional block F5 based on the output of the functional block F2.

The functional block F6 is configured to calculate a command value for operating an actuator. According to the example of FIG. 10, the functional block F6 calculates the command value $\beta_{1r}$ for the boom angle $\beta_1$, the command value $\beta_{2r}$ for the arm angle $\beta_2$, the command value $\beta_{3r}$ for the bucket angle N, and the command value $\alpha_{1r}$ for the swing angle $\alpha_1$ based on the target teeth tips position calculated by the functional block F3, in order to move from the current teeth tips position to the target teeth tips position. The functional block F6 calculates the command value $\beta_{1r}$ on an as-needed basis even when the boom 4 is not operated. This is for causing the boom 4 to automatically operate. The same is the case with the arm 5, the bucket 6, and the swing mechanism 2.

Next, functional blocks for causing a self-operating unmanned shovel to operate are described. The above-described functional blocks F1 through F6 and FA through FL are used in causing a self-operating unmanned shovel to operate and in causing a manually operated manned shovel to operate alike.

A communications device T1 is configured to control communications between the shovel 100 and an external apparatus outside the shovel 100. According to the example of FIG. 10, the communications device T1 is configured to output a start command to the functional block FM based on a signal received from the external apparatus. The communications device T1 may also be configured to output operation data to the functional block FM based on a signal received from the external apparatus. The communications device T1 may be the input device 43 installed in the shovel 100.

The functional block FM is configured to determine the start of work. According to the example of FIG. 10, the functional block FM is configured to determine that the start of work is commanded and output a start command to the functional block FN, in response to receiving the start command from the communications device T1. The functional block FM may also be configured to output a start command to the functional block FN in response to determining that no object is present in an area surrounding the shovel 100 based on the output of the image capturing device 80 serving as a surroundings monitoring device, when receiving the start command from the communications device T1. The functional block FM may output a command to a solenoid opening and closing valve placed in a pilot line connecting the pilot pump 15 and the control valve unit 17 to open the pilot line in outputting a start command to the functional block FN.

The functional block FN is configured to determine the details of an operation. According to the example of FIG. 10, the functional block FN is configured to determine which of an excavating operation, a boom raising and swing operation, a dumping operation, a boom lowering and swing operation, etc., is being currently performed or whether none of the operations is being performed, based on the current teeth tips position calculated by the functional block F2, in response to receiving the start command from the functional block FM. The functional block FN is configured to output a start command to the functional block FO in response to determining that a boom raising and swing operation has ended based on the current teeth tips position calculated by the functional block F2.

The functional block FO is configured to set operating conditions of the shovel 100. According to the example of FIG. 10, the functional block FO is configured to set operating conditions such as dumping speed in the case where a dumping operation is performed by autonomous control and the bucket angle $\beta_3$ at the start of dumping in response to receiving the start command from the functional block FN. The functional block FO is configured to output a start command to the functional block FP after setting the operating conditions.

The functional block FP is configured to determine the start of a predetermined operation. According to the example of FIG. 10, the functional block FP determines whether it is possible to start a dumping operation based on the current teeth tips position of the bucket 6 calculated by the functional block F2 in response to receiving the start command from the functional block FO. Specifically, the functional block FP determines, based on the current teeth tips position, whether a boom raising and swing operation is finished, whether the teeth tips of the bucket 6 have reached a dumping start point, etc. In response to determining that a boom raising and swing operation is finished and that the teeth tips of the bucket 6 have reached a dumping start point, the functional block FP determines that it is possible to start a dumping operation. In response to determining that it is possible to start a dumping operation, the functional block FP inputs operation data automatically generated in the self-operating unmanned shovel to the functional block F3.

According to this configuration, the controller 30 can also perform an excavating operation with autonomous control in a self-operating unmanned shovel, the same as in a manually operated manned shovel.

Furthermore, according to the above-described embodiment, a hydraulic operation system including hydraulic pilot circuit is disclosed. Specifically, in a hydraulic pilot circuit associated with the operation of the arm 5, hydraulic oil supplied from the pilot pump 15 to the remote control valve of the left operating lever 26L is conveyed to a pilot port of the control valve 176 serving as an arm control valve at a flow rate commensurate with the degree of opening of the remote control valve that is opened and closed by the tilt of the left operating lever 26L in the forward and the backward direction.

Instead of such a hydraulic operation system including a hydraulic pilot circuit, however, an electric operation system including an electric operating lever with an electric pilot circuit may be adopted. In this case, the amount of lever operation of the electric operating lever is input to the controller 30 as an electrical signal. Furthermore, a solenoid valve is placed between the pilot pump 15 and a pilot port of each control valve. The solenoid valve is configured to operate in response to an electrical signal from the controller 30. According to this configuration, when a manual operation using the electric operating lever is performed, the controller 30 can move each control valve in the control valve unit 17 by increasing or decreasing a pilot pressure by controlling the solenoid valve with an electrical signal commensurate with the amount of lever operation. Each control valve may be constituted of a solenoid spool valve. In this case, the solenoid spool valve operates in response to an electrical signal from the controller 30 commensurate with the amount of lever operation of the electric operating lever.

Figure 11:
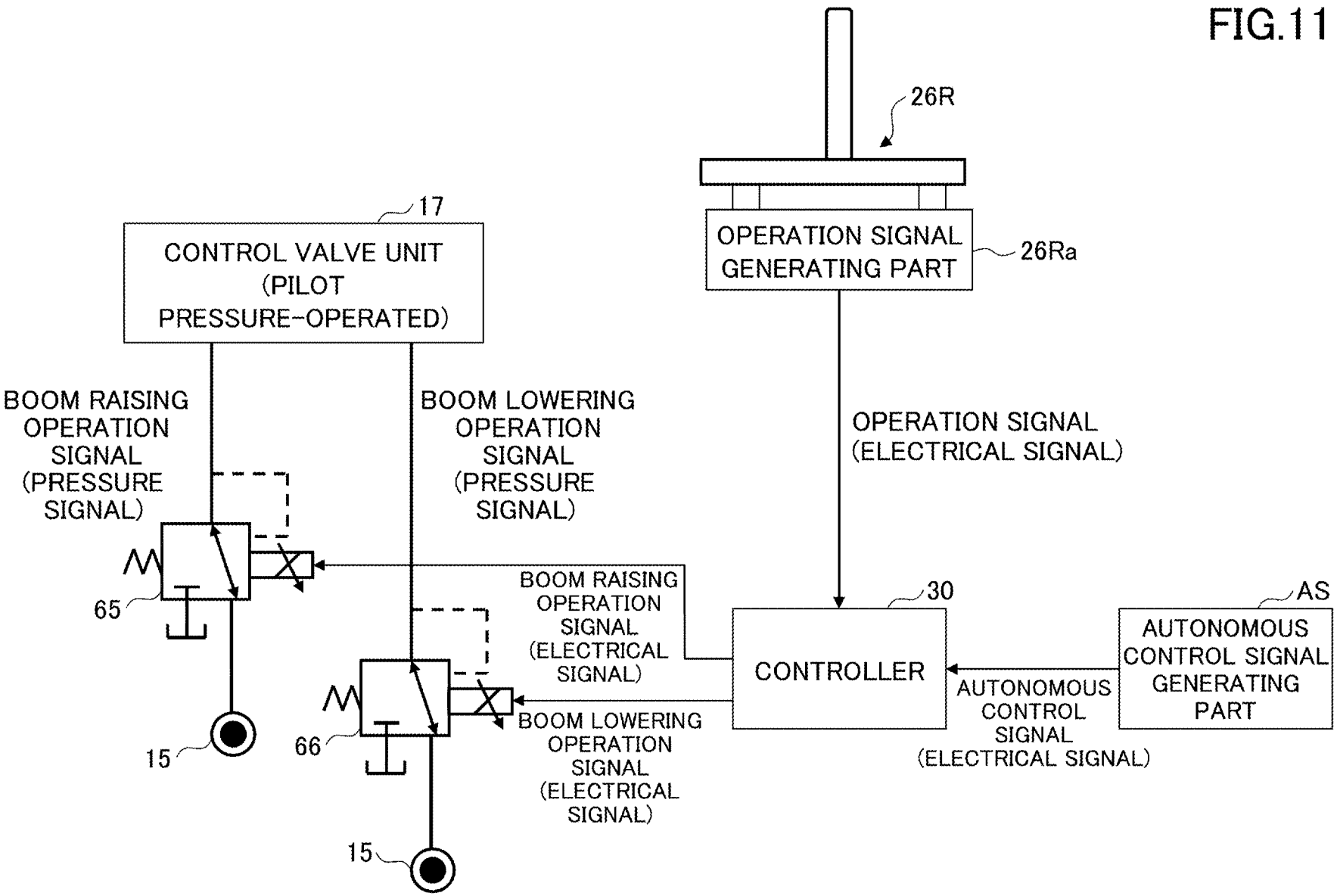
FIG. 11 is a diagram illustrating an example configuration of an electric operation system.

When the electric operation system including an electric operating lever is adopted, the controller 30 can more easily execute the autonomous control function than in the case where the hydraulic operation system including a hydraulic operating lever is adopted. FIG. 11 illustrates an example configuration of the electric operation system. Specifically, the electric operation system of FIG. 11 is an example of a boom operation system, and is constituted mainly of a pilot pressure-operated control valve unit 17, the right operating lever 26R serving as an electric operating lever, the controller 30, a solenoid valve 65 for boom raising operation, and a solenoid valve 66 for boom lowering operation. The electric operation system of FIG. 11 may also be likewise applied to an arm operation system, a bucket operation system, etc.

The pilot pressure-operated control valve unit 17 includes the control valve 175 (see FIG. 2) associated with the boom cylinder 7, the control valve 176 (see FIG. 2) associated with the arm cylinder 8, the control valve 174 (see FIG. 2) associated with the bucket cylinder 9, etc. The solenoid valve 65 is configured to be able to adjust the flow area of a conduit connecting the pilot pump 15 and the raising-side pilot port of the control valve 175. The solenoid valve 66 is configured to be able to adjust the flow area of a conduit connecting the pilot pump 15 and the lowering-side pilot port of the control valve 175.

When a manual operation is performed, the controller 30 generates a boom raising operation signal (electrical signal) or a boom lowering operation signal (electrical signal) in accordance with an operation signal (electrical signal) output by an operation signal generating part 26Ra of the right operating lever 26R. The operation signal output by the operation signal generating part 26Ra of the right operating lever 26R is an electrical signal that changes in accordance with the amount of operation and the direction of operation of the right operating lever 26R.

Specifically, when the right operating lever 26R is operated in the boom raising direction, the controller 30 outputs a boom raising operation signal (electrical signal) commensurate with the amount of lever operation to the solenoid valve 65. The solenoid valve 65 adjusts the flow area according to the boom raising operation signal (electrical signal) to control a pilot pressure serving as a boom raising operation signal (pressure signal) to be applied to the raising-side pilot port of the control valve 175. Likewise, when the right operating lever 26R is operated in the boom lowering direction, the controller 30 outputs a boom lowering operation signal (electrical signal) commensurate with the amount of lever operation to the solenoid valve 66. The solenoid valve 66 adjusts the flow area according to the boom lowering operation signal (electrical signal) to control a pilot pressure serving as a boom lowering operation signal (pressure signal) to be applied to the lowering-side pilot port of the control valve 175.

In the case of executing autonomous control, the controller 30, for example, generates the boom raising operation signal (electrical signal) or the lowering operation signal (electrical signal) in accordance with an autonomous control signal (electrical signal) output by an autonomous control signal generating part AS, instead of responding to the operation signal (electrical signal) output by the operation signal generating part 26Ra of the right operating lever 26R. The autonomous control signal may be an electrical signal generated by the controller 30 or an electrical signal generated by an external control device or the like other than the controller 30.

Figure 12:
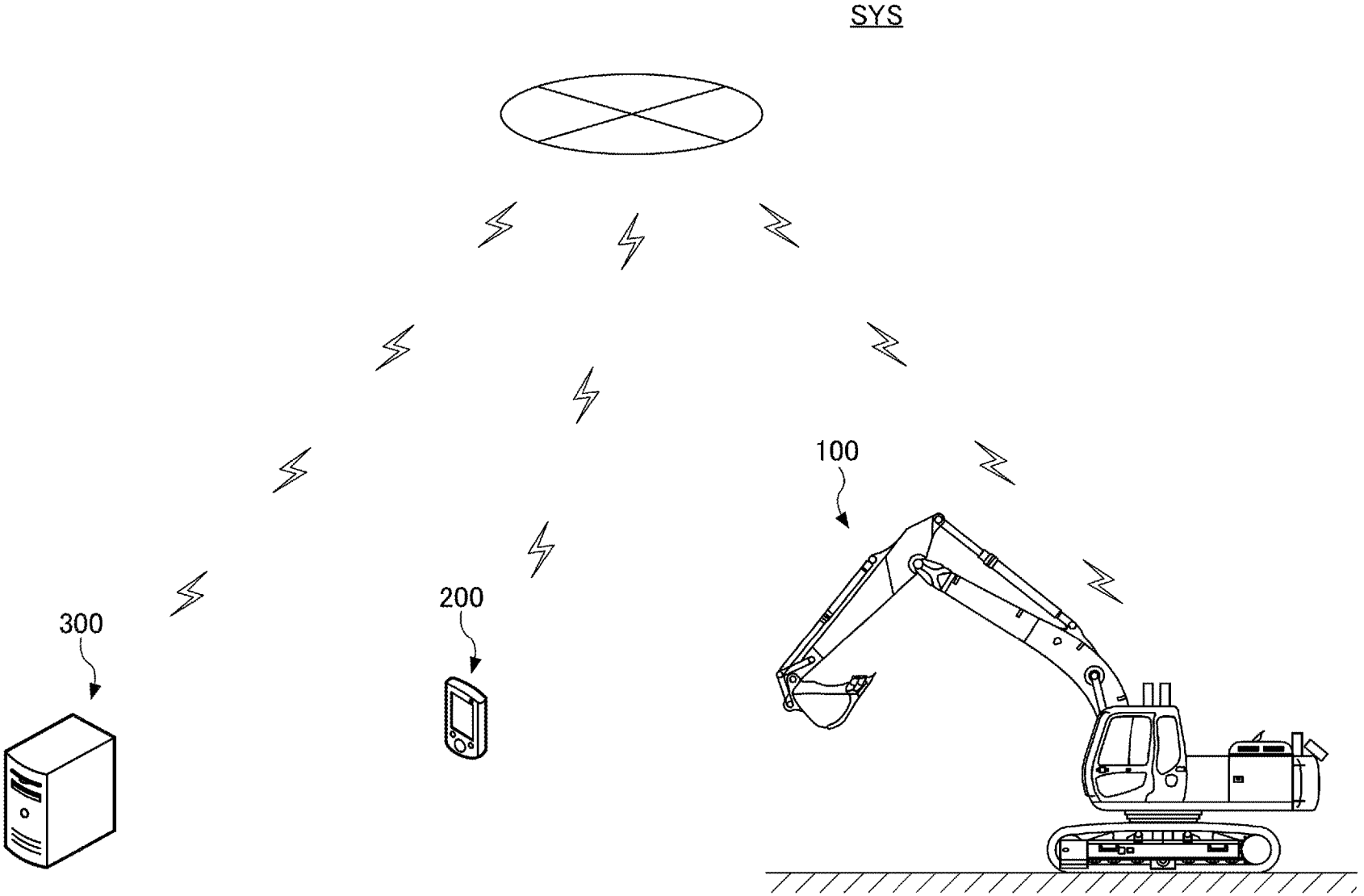
FIG. 12 is a schematic diagram illustrating an example configuration of a shovel management system.

Information obtained by the shovel 100 may be shared with a manager, operators of other shovels, etc., through a shovel management system SYS as illustrated in FIG. 12. FIG. 12 is a schematic diagram illustrating an example configuration of the shovel management system SYS. The management system SYS is a system that manages one or more shovels 100. According to this embodiment, the management system SYS is constituted mainly of the shovel 100, an assist device 200, and a management apparatus 300. Each of the shovel 100, the assist device 200, and the management apparatus 300 constituting the management system SYS may be one or more in number. According to the example of FIG. 12, the management system SYS includes the single shovel 100, the single assist device 200, and the single management apparatus 300.

The assist device 200 is typically a portable terminal device, and is, for example, a notebook PC, a tablet PC, a smartphone or the like carried by a worker or the like at a worksite. The assist device 200 may also be a computer carried by the operator of the shovel 100. The assist device 200 may also be a stationary terminal apparatus.

The management apparatus 300 is typically a stationary terminal apparatus, and is, for example, a server computer installed in a management center or the like outside a worksite. The management apparatus 300 may also be a portable computer (for example, a portable terminal device such as a notebook PC, a tablet PC, or a smartphone).

At least one of the assist device 200 and the management apparatus 300 may be provided with a monitor and an operating device for remote control. In this case, the operator may operate the shovel 100 while using the operating device for remote control. The operating device for remote control is connected to the controller 30 through a communications network such a radio communications network, for example. While the exchange of information between the shovel 100 and the management apparatus 300 is described below, the following description is similarly applied to the exchange of information between the shovel 100 and the assist device 200.

According to the management system SYS of the shovel 100 as described above, the controller 30 of the shovel 100 may transmit, to the management apparatus 300, information on at least one of the time and location of starting or stopping autonomous control, a target trajectory used in autonomous control, a trajectory actually followed by a predetermined part in autonomous control, etc. In this case, the controller 30 may transmit, for example, an image captured by the image capturing device 80 serving as a surroundings monitoring device, etc., to the management apparatus 300. The image may be multiple images captured during a predetermined period including the period of the execution of autonomous control. Furthermore, the controller 30 may transmit, to the management apparatus 300, information on at least one of data on the work details of the shovel 100, data on the pose of the shovel 100, data on the pose of the excavation attachment AT, etc., during predetermined period including the period of the execution of autonomous control. This is for enabling a manager using the management apparatus 300 to access information on a worksite. The data on the work details of the shovel 100 is at least one of, for example, the number of times of loading that is the number of times a dumping operation is performed, information on an excavation object such as earth loaded onto the bed BD of the dump truck DT, the type of the dump truck DT with respect to loading work, information on the position of the shovel 100 when loading work is performed, information on a work environment, information on the operation of the shovel 100 during loading work, etc. The information on an excavation object is at least one of, for example, the weight, type, etc., of an excavation object excavated by an excavating operation of each time, the weight, type, etc., of an excavation object loaded into the dump truck DT, the weight, type, etc., of an excavation objected loaded by a day's loading work, etc. The information on a work environment is, for example, information on the inclination of the ground in an area surrounding the shovel 100, information on the weather around a work site, or the like. The information on the operation of the shovel 100 is at least one of, for example, the output of the operating pressure sensor 29, the output of the cylinder pressure sensor S10, etc.

Furthermore, according to the above-described embodiment, the autonomous control part 30B is configured to autonomously assist the operator in manually operating the shovel 100. For example, when the operator is manually performing an arm closing operation, the autonomous control part 30B causes at least one of the boom cylinder 7, the arm cylinder. 8, the bucket cylinder 9, and the swing hydraulic motor 2A such that the trajectory of the teeth tips of the bucket 6 coincides with a target trajectory. The present invention, however, is not limited to this configuration. For example, the autonomous control part 30B may cause at least one of the boom cylinder 7, the arm cylinder 8, the bucket cylinder 9, and the swing hydraulic motor 2A such that the trajectory of the teeth tips of the bucket 6 coincides with a target trajectory when the operator is not operating the operating device 26. That is, the autonomous control part 30B may autonomously move the excavation attachment AT independent of the operator's operation. In this case, the autonomous control part 30B may be configured to be able to appropriately move the excavation attachment AT using artificial intelligence technology.

Furthermore, the controller 30 may also be configured to calculate the weight of an excavation object such as earth during a boom raising and swing operation. For example, the controller 30 calculates the weight of the excavation object based on the balance of two torques about a boom foot pin that act on the boom 4. The two torques are a rising torque (holding torque) to act in a direction to raise the boom 4 and a lowering torque (gravitational torque) to act in a direction to lower the boom 4. The holding torque is calculated based on a thrust generated by the extending boom cylinder 7 and increases as the thrust increases. The thrust generated by the extending boom cylinder 7 is calculate based on the outputs of the boom rod pressure sensor and the boom bottom pressure sensor. The gravitational torque includes a torque due to the own weight of the excavation attachment AT and a torque due to the weight of the excavation object. The torque due to the own weight of the excavation attachment AT is calculated based on the distance between the position of the center of gravity of the excavation attachment AT and the boom foot pin, which is the pivot center of the boom 4 and the own weight of the excavation attachment AT. The torque due to the weight of the excavation object is calculated based on the distance between the position of the center of gravity of the excavation object and the boom foot pin and the weight of the excavation object. The position of the center of gravity of the excavation attachment AT is derived from the pose of the excavation attachment AT. The controller 30 may derive the position of the center of gravity of the excavation attachment AT, referring to a reference table that defines the correspondence between the pose and the position of the center of gravity of the excavation attachment AT stored in the nonvolatile storage, for example. The pose of the excavation attachment AT is derived based on the output of the pose detector. The own weight of the excavation attachment AT is known, and may be prestored in the nonvolatile storage. The controller 30 may derive the torque due to the own weight of the excavation attachment AT, referring to a reference table that defines the correspondence between the pose of the excavation attachment AT and the torque due to the own weight of the excavation attachment AT.

The controller 30 may calculate the torque due to the weight of the excavation object in the gravitational torque by subtracting the magnitude of the torque due to the own weight of the excavation attachment AT in the gravitational torque from the magnitude of the holding torque. This is because the magnitude of the holding torque is balanced with the magnitude of the gravitational torque. Furthermore, this is because the gravitational torque is the sum of the torque due to the own weight of the excavation attachment AT and the torque due to the weight of the excavation object.

Then, the controller 30 can calculate the weight of the excavation object based on the magnitude of the torque due to the weight of the excavation object in the gravitational torque and the position of the center of gravity of the excavation object. The position of the center of gravity of the excavation object is calculated from the shape of the excavation object derived based on the output of the object detector 70, for example. The position of the center of gravity of the excavation object may be preset as a predetermined point within the bucket 6.

According to this embodiment, the controller 30 is configured to calculate the weight of the excavation object each time a dumping operation is finished and a boom raising and swing operation starts. Then, during loading on the same single dump truck DT, the controller 30 calculates the total weight of the excavation object loaded onto the bed BD of the dump truck DT by integrating the weights of excavation objects each calculated each time a boom raising and swing operation starts. When the dump truck DT to be loaded switches, the total weight of the excavation object is reset to zero.

If the sum of the weight of the excavation object currently scooped into the bucket 6 and the total weight of the excavation object already loaded onto the bed BD of the dump truck DT may exceed the maximum loading capacity of the dump truck DT, the controller 30 may suspend the dumping operation in the middle without dumping the excavation object in the bucket 6. In this case, after calculating the weight of an excessive excavation object, the controller 30 may calculate the volume of the excessive excavation object and suspend the dumping operation in the middle such that an excavation object of the volume remains in the bucket 6. The controller 30 may perform a leveling operation with the back surface of the bucket 6 with the excavation object left in the bucket 6.

What is claimed is:

1. A shovel comprising:

a lower traveling structure;

an upper swing structure swingably mounted on the lower traveling structure; and a hardware processor provided on the upper swing structure, and configured to recognize a position of a dump truck and create a target trajectory for a dumping operation, the target trajectory being a trajectory drawn by a predetermined part of the shovel during the dumping operation, wherein the target trajectory is a virtual line segment connecting a dumping start point and a dumping end point over a bed of the dump truck, the dumping start point being a first predetermined interval apart from a rear gate of the dump truck, the dumping end point being a second predetermined interval apart from a front panel of the dump truck.

2. The shovel as claimed in claim 1, wherein the target trajectory is set along a longitudinal direction of the dump truck.

3. The shovel as claimed in claim 1, wherein the target trajectory is set at a predetermined height along a bottom surface of the bed of the dump truck.

4. The shovel as claimed in claim 1, wherein the hardware processor is further configured to set a bucket angle for each of points on the target trajectory.

5. The shovel as claimed in claim 1, wherein the hardware processor is further configured to control a bucket angle based on a shape of a load loaded onto the bed of the dump truck.

6. The shovel as claimed in claim 1, wherein the hardware processor is further configured to detect a distance between a back surface of a bucket and the dump truck.

7. The shovel as claimed in claim 1, wherein the hardware processor is further configured to cause the target trajectory to differ from dumping operation to dumping operation.

8. The shovel as claimed in claim 1, wherein the hardware processor is further configured to determine a height of a newly formed load each time the dumping operation is performed.

9. The shovel as claimed in claim 1, wherein the hardware processor is further configured to cause a bucket to operate to level an upper surface of a newly formed load with a back surface of the bucket, when a height of the load exceeds a predetermined height.

10. The shovel as claimed in claim 1, wherein the hardware processor is further configured to determine a width of a newly formed load each time the dumping operation is performed.

11. The shovel as claimed in claim 1, wherein the hardware processor is further configured to set the dumping start point and the dumping end point.

12. A controller for a shovel, the shovel including a lower traveling structure and an upper swing structure swingably mounted on the lower traveling structure, the controller comprising:

a hardware processor configured to configured to recognize a position of a dump truck and create a target trajectory for a dumping operation, the target trajectory being a trajectory drawn by a predetermined part of the shovel during the dumping operation, wherein the target trajectory is a virtual line segment connecting a dumping start point and a dumping end point over a bed of the dump truck, the dumping start point being a first predetermined interval apart from a rear gate of the dump truck, the dumping end point being a second predetermined interval apart from a front panel of the dump truck.

13. The controller as claimed in claim 12, wherein the hardware processor is further configured to cause the target trajectory to differ from dumping operation to dumping operation.

14. The controller as claimed in claim 12, wherein the hardware processor is further configured to determine a height of a newly formed load each time the dumping operation is performed.

15. The controller as claimed in claim 12, wherein the hardware processor is further configured to cause a bucket to operate to level an upper surface of a newly formed load with a back surface of the bucket, when a height of the load exceeds a predetermined height.

* * * * *